United States Patent [19]

Simonson et al.

[11] Patent Number: 4,767,499

[45] Date of Patent: Aug. 30, 1988

[54] METHOD FOR THE PRODUCTION OF FIBER PULP BY IMPREGNATING LIGNOCELLULOSIC MATERIAL WITH A SULPHONATING AGENT PRIOR TO REFINING

[76] Inventors: Rune G. W. Simonson, Sotenäsvägen 64, S-433 64 Partille; Per O. Axelson, Bordsvägen 29, S-122 46 Enskede, both of Sweden

[21] Appl. No.: 85,221

[22] Filed: Aug. 13, 1987

Related U.S. Application Data

[63] Continuation of Ser. No. 601,709, Apr. 18, 1984, abandoned, which is a continuation-in-part of Ser. No. 363,573, Apr. 30, 1982, abandoned.

[30] Foreign Application Priority Data

Apr. 3, 1981 [SE] Sweden ..... 8102138

[51] Int. Cl.[4] ..... D21C 3/06; D21B 1/16

[52] U.S. Cl. ..... 162/25; 162/26; 162/83; 162/84

[58] Field of Search ..... 162/24, 25, 26, 82, 162/83, 84, 17, 19, 68

[56] References Cited

U.S. PATENT DOCUMENTS

| | | | |
|---|---|---|---|
| 2,610,119 | 9/1952 | Magnuson | 162/17 |
| 3,013,931 | 12/1961 | Wethern et al. | 162/83 |
| 4,116,758 | 9/1978 | Ford et al. | 162/83 |
| 4,247,362 | 1/1981 | Williams | 162/83 |
| 4,259,148 | 3/1981 | Beath | 162/83 |

OTHER PUBLICATIONS

Axelson et al., "Thermomechanical Pulping With Low Addition of Sulfite" Preprint Int. Mech. Pulp. Conf., Oslo, Jun. 1981, Revised 3-1982.

*Primary Examiner*—Steve Alvo

[57] ABSTRACT

A method for the production of fiber pulp from lignocellulosic material containing at least 70% spruce or spruce-like material. The method comprises the steps of lignin softening and defibration/refining, the step of lignin softening being performed prior to the step of defibration/refining and comprising impregnating the starting material with a dilute aqueous solution of a lignin softening agent, namely a solution of sulfurous acid, metal bisulfite salts and/or metal sulfite salts in an amount sufficient to provide a defibrated/refined pulp containing an absorbed and bonded amount of sulfonate groups within the range of from 0.06 to 0.75 wt.-%, calculated as $Na_2SO_3$ and based on the dry pulp weight. The absorbed and bonded amount of sulfonate groups is balanced to the composition of the starting material and the temperature-pressure conditions in the defibration step to provide a pulp of maximum tensile strength such as to represent a point within the polygon ABGH in FIG. 1.

The invention makes it possible to utilize favorable effects, not earlier known, resulting from very low concentrations of the lignin softening agent, and to produce a pulp with high yield and optimum strength and optical properties at a comparatively low energy input in the defibrator/refiner.

12 Claims, 19 Drawing Sheets

METHOD FOR THE PRODUCTION OF FIBER PULP BY IMPREGNATING LIGNOCELLULOSIC MATERIAL WITH A SULPHONATING AGENT PRIOR TO REFINING

This application is a continuation of application Ser. No. 601,709, filed Apr. 18, 1984, and now abandoned; which was a continuation-in-part of Ser. No. 363,573 filed Apr. 30, 1982 and now abandoned.

FIELD OF INVENTION

This invention relates to a method for the production of fiber pulps of high strength from a lignocellulosic starting material consisting of at least 70% spruce or spruce-like materials, said method comprising an impregnation step at which lignin-softening chemicals in the form of sulfurous acid, metal bisulfite salts and/or metal sulfite salts, preferably sodium sulfite ($Na_2SO_3$, are added to the material before its defibration in order to soften the material properly.

BACKGROUND AND PRIOR ART

The defibration of different wood materials is facilitated if the fiber material is first preheated with steam (i.e. water vapor) for a certain period of time, preferably at increased pressure and increased temperature. The so-called thermomechanical pulping (TMP) process is designed in this way and produces pulps with a high yield (≧95%). The brightness of such pulps is affected by the type and quality of the wood material used, but usually is 55–60% (ISO).

An addition of chemicals before or during the mechanical treatment has been found to result in improved strength properties of the pulp compared to the properties of a purely thermomechanical pulp. Chemithermomechanical pulps (CTMP, yield usually <95%) are produced today, but then at chemical batching levels which considerably exceed those used in the present invention. The results published so far show that with such a high and increased concentration of chemicals, an increased tensile strength of the paper is obtained at constant drainability (expressed as millilitres Canadian Standard Freeness), but at the expense of an increased total expenditure of beating energy. Another adverse effect of an increased addition of chemicals has been reported, viz. a pronounced decrease in the light-scattering ability (opacity). Besides certain strength properties, a high light-scattering coefficient is an essential requirement in connection with printing paper pulps and, therefore, the chemical strength-improving treatment had to be limited so that the optical properties will not deteriorate too much.

When producing fiber pulps it is known (Ford et al, U.S. Pat. No. 4,116,758, Sept. 26, 1978) to expose the starting materials to a combined chemical, thermal and mechanical treatment to increase the strength properties of the finished pulp. In said patent it is stated that, to be able to obtain a sufficiently high strength but still maintain an acceptable yield, when treating spruce wood, it is necessary to add fairly large amounts of chemicals. Thus, as a lower limit for the added amount of chemicals, the patentees state that it is necessary to add at least 85% and preferably at least 90% of the maximum level of sulfonation which for spruce is stated to be 0.65 wt % S, as combined sulfur. Thus, when treating spruce in the manner taught by Ford et al, it is necessary to add an amount of chemicals giving at least 0.55 wt % chemically bonded sulfur. The upper limit of the added amount of chemicals is determined by the objective of obtaining at least 90 wt % yield. The high added amounts of chemicals in this prior art method make it necessary to use a separate sulfite recovery system in view of the economy and the present environmental demands.

As examples of other prior art processes in which a fiber pulp is produced by chemical and mechanical treatments of wood fibers mention may be made of British Pat. GB-A No. 1,546,877 and Australian Pat. No. 469,905. Thus, GB-A No. 1,546,877 describes a process of producing a light, lignin-rich, absorbing pulp at a high yield to be used as a raw material for producing tissue, cellulosic wadding, diapers, sanitary towels and tampons. In this process, the objective is to obtain a pulp with high absorbancy at a high yield and no mention is made of the strength of a paper made from the pulp produced. The Australian Pat. No. 469,905 describes a process of treating wood fibers using a solution of sodium hexametaphosphate, possibly in combination with sodium sulphite. However, high amounts of chemicals are used according to this patent.

BRIEF SUMMARY OF INVENTION

One object of the present invention is to improve the production of fiber pulps using a combined chemical and mechanical treatment of spruce or spruce-like materials or mixtures containing at least 70% spruce or spruce-like materials. Another object of the present invention is to produce a fiber pulp giving a high yield and a high degreee of utilization of used chemicals eliminating or substantially eliminating the need for an intermediate washing step before the subsequent pulp treatments as well as eliminating or substantially eliminating the need for a separate sulfite recovery system. A further object of the present invention is to produce a fiber pulp at a low chemical cost using a low energy input and still obtaining good strength properties and a high light-scattering coefficient. A still further object of the present invention is to produce a fiber pulp with good properties for use in different grades of printing paper such as newsprint. Another object of the present invention is to produce a fiber pulp of high quality from a lignocellulosic fiber material by chemically pretreating this material in a balanced way before defibration, making use of the favorable effects resulting from a very low impregnating level of chemicals and at the same time obtaining a pulp with high yield (≧95%) and with optimum strength and optical properties at a comparatively low expenditure of beating energy.

The above objects and other objects of the invention are obtained by a method using a lignocellulosic starting material and comprising the steps of lignin softening and defibration/refining, said lignocellulosic starting material being selected from the group consisting of spruce, spruce-like materials and mixtures of lignocellulosic materials, said mixtures containing at least 70% spruce or spruce-like materials, and said step of lignin softening comprising impregnating, before said defibration, said starting material with a dilute aqueous solution of a lignin softening agent selected from the group comprising sulfurous acid, metal bisulfite salts, metal sulfite salts and mixtures thereof, in a sufficient amount to provide in the fiber pulp after said step of defibration/refining an absorbed and bonded amount of sulfonate groups within the range of from 0.06 to 0.75 wt. %, calculated as $Na_2SO_3$ and based on the dry pulp weight, said absorbed and bonded amount being balanced to the composition of the starting material and the temperature-pressure conditions in the defibration step to provide a pulp of maximum tensile strength.

BRIEF DESCRIPTION OF DRAWINGS

The invention and its different aspects will be described in the following with reference to the accompanying drawings in which.

GENERAL DESCRIPTION OF THE INVENTION

Figure 1:
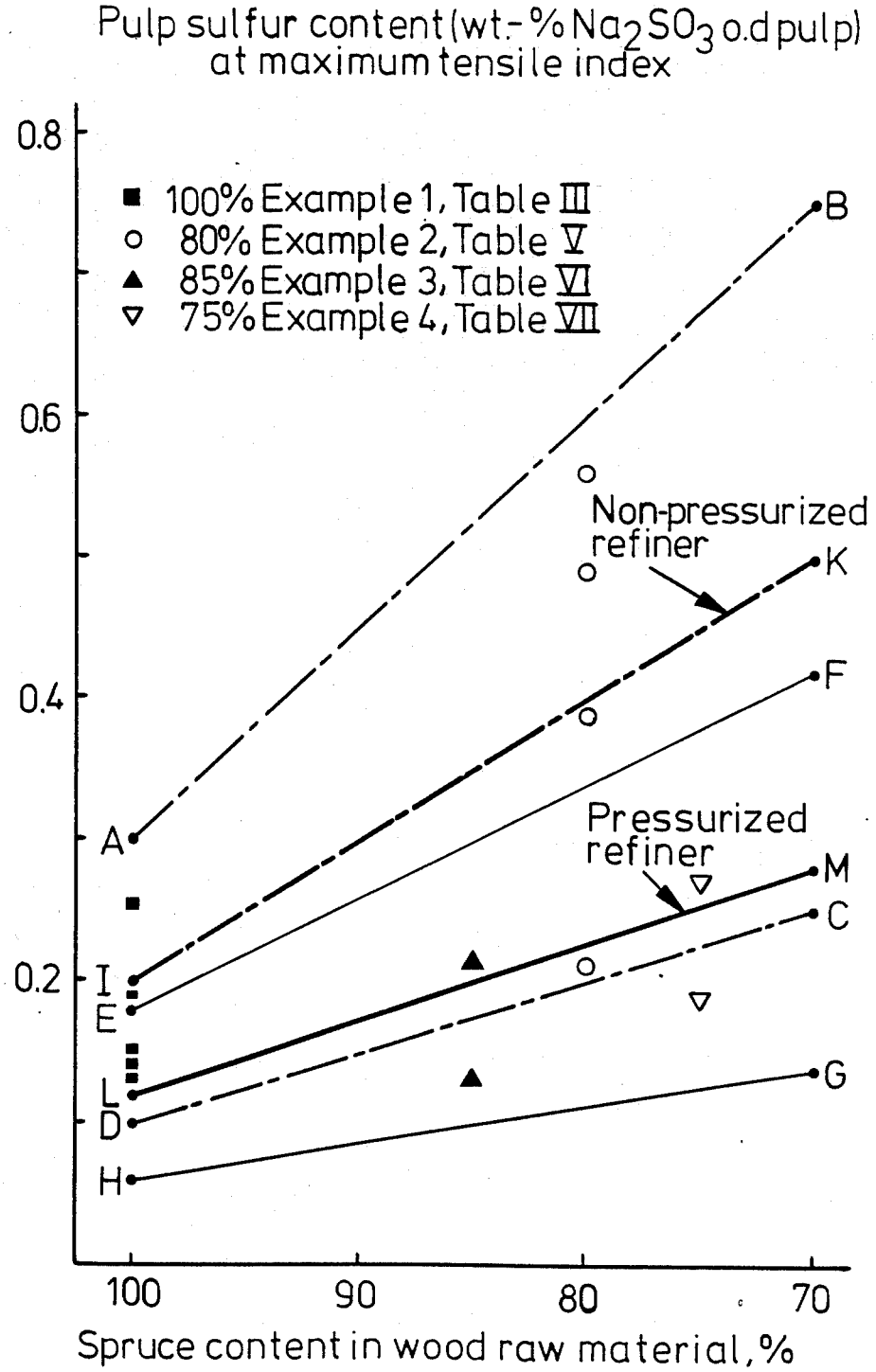
FIG. 1 is a diagram which shows a combination of four different Examples illustrating the invention and which shows the sulfur content of the pulp of this invention at maximum tensile index as a function of the spruce content of the wood raw material.

The present invention is based on the unexpected discovery that very good results with respect to pulp quality and energy input at lower sulfite additions to the spruce wood than hitherto considered possible are obtained. Thus, the best results in these respects have been found at sulfite additions amounting to only a few tenths of one per cent (calculated as wt. % $Na_2SO_3$ on oven dry wood). In this Application, all representations of sulfur content of the pulp are expressed as weight percentage of sodium sulfite ($Na_2SO_3$), calculated on completely dry pulp, i.e. oven dry pulp, and is independent of the actual sulfur source.

In producing fiber pulps of high strength from a lignocellulosic starting material according to the present invention, the starting material is selected from the group consisting of spruce, spruce-like materials and mixtures of lignocellulosic materials, said mixtures containing at least 70% spruce or spruce-like materials. Where the term spruce is used herein, it is understood to include spruce and spruce-like materials exhibiting spruce-like characteristics for the purposes of this invention, i.e. comparatively long fibers (which excludes hardwoods like birch, maple etc), comparatively small ray-tracheid contact area, and comparatively low resin content. On refining a wood mixture, the minor part of the mixture may consist of pine or aspen wood.

The step of lignin softening in the method according to the present invention comprises impregnating, before the defibration, said starting material with dilute aqueous solution of a lignin softening agent selected from the group comprising sulfurous acid, metal bisulfite salts, metal sulfite salts and mixtures thereof, Preferred chemicals and amounts are described below. According to the invention the added amount of lignin softening agent shall be lower than hitherto used in producing fiber pulps of high strength and high light-scattering quality at high yields, i.e. an amount such as to provide in the fiber pulp after the defibration/refining step an absorbed and bonded amount of sulfonate groups within the range from 0.06 to 0.75 wt. %, calculated as $Na_2SO_3$ and based on the dry pulp weight, said absorbed and bonded amount being balanced to the composition of the starting material and the temperature-pressure conditions in the defibration step to provide a pulp of maximum tensile strength.

As stated above, the said absorbed and bonded amount of said ligning softening agent has to be balanced to the composition of the starting material and the temperature-pressure conditions in the defibration step to provide a pulp of maximum tensile strength. At present we consider it best to balance the absorbed and bonded amount of sulfonate groups to meet the spruce-wood content of said starting material and defibrating conditions defined by the polygon ABGH in FIG. 1. When using atmospheric defibrating conditions, we prefer values representing a point within the polygon ABCD in FIG. 1, most preferably a point on the straight line IK in FIG. 1. However, when defibrating in a commercial defibrator using 140 kPa defibrating pressure, we prefer values representing a point within the polygon EFGH in FIG. 1, most preferably a point on the straight line LM in FIG. 1. The coordinates of the points A–M are the following:

| | Spruce content | S as $Na_2SO_3$ |
|---|---|---|
| A | 100 wt. % | 0.3 wt. % |
| B | 70 wt. % | 0.75 wt. % |
| C | 70 wt. % | 0.25 wt. % |
| D | 100 wt. % | 0.1 wt. % |
| E | 100 wt. % | 0.18 wt. % |
| F | 70 wt. % | 0.42 wt. % |
| G | 70 wt. % | 0.14 wt. % |
| H | 100 wt. % | 0.06 wt. % |
| I | 100 wt. % | 0.2 wt. % |
| K | 70 wt. % | 0.5 wt. % |
| L | 100 wt. % | 0.12 wt. % |
| M | 70 wt. % | 0.28 wt. % |

To improve the impregnation of the wood chips with said dilute aqueous solution, we prefer to subject the starting material to steaming to raise the temperature of the starting material to the temperature of the water vapor used for steaming before contacting the wood chips with the solution. Said steaming is preferably performed at about atmospheric pressure and for at least about 10 minutes. After such steaming, we prefer to impregnate the hot wood chips with said solution initially having about room temperature for at least about 10 minutes at about atmospheric pressure. Such a combination of hot wood chips and low-temperature impregnation solution seems to improve the results. At present, we also prefer to preheat the impregnated material between the impregnation and defibration steps, especially when a low temperature impregnation solution has been used. A preheating at about 110°–130° C. for about 3 minutes is considered to be optimum at present.

The defibration step can be performed in commercial disk-refiners operating at a beater casing pressure in the range from atmospheric to 140 kPa. In the following Examples 1 and 2 a Sund/Bauer 400 double-disk refiner equipped with Sund's TD 202 plates was used. In the following Examples 3 and 4 a steam-pressurized Asplund RLP 50S, single-disk Raffinator was used as a first-stage refiner. In the second-stage refining, a non-pressurized Asplund RL 50S Raffinator was used.

Investigations made by us have shown that an efficient chemical treatment of the fiber material, usually wood chips, is achieved by the impregnation of the chips with said lignin-softening agent to such an extent that, after defibration, the absorbed and bonded amount thereof constitutes only fractions of one percent calculated as wt. % $Na_2SO_3$ on absolutely dry pulp (oven dry pulp, o.d. pulp). Impregnation is preferably carried out by immersing the wood chips in a comparatively cold sulfite solution, preferably having a temperature of 20°–60° C., at atmospheric pressure and for a short period of time, usually about 10 min. As a consequence of the desired low content of sulfite in the wood material, the concentration of the sulfite solution used for the impregnation can be kept low and at a value which, with respect to the liquor uptake during impregnation, gives the desired sulfite content in the chips, and which, with respect to the degree of utilization, gives the desired content in the defibered pulp. Immediately before impregnation, the wood chips are steamed at atmospheric pressure with water vapor for about 10 min, during which treatment the wood material should reach a temperature of 90°–100° C. After impregnation, the impregnated wood material is defibrated and refined in a conventional thermomechanical pulping stage including preheating for about 3 min at a temperature of preferably 115°–126° C. Defibration is carried out in a substantially open, first-stage disc refiner.

On defibration/refining in a pressurized, first-stage disc refiner having an average temperature in the beating zone which normally is higher than that in an open disc refiner, a lower degree of chemical lignin softening is required to achieve optimum conditions with respect to pulp properties and energy requirements. Otherwise, there is easily reached a critical state where the defibration occurs at a temperature above the lignin softening temperature, resulting in a deteriorated product and/or deteriorated beating conditions.

On defibration/refining of a spruce/pine wood mixture, optimum conditions are achieved at a somewhat higher impregnating level than that required for pure spruce wood. The amount of chemicals required is determined by the spruce content of the wood raw material.

FIG. 1 shows the pulp sulfur content (expressed as wt. % $Na_2SO_3$ calculated on absolutely dry pulp, oven-dried pulp) at maximum tensile index (see. FIGS. 6, 12, 14, and 17) as a function of the spruce content (wt. %) in the wood raw material.

The dot-dash lines AB, CD and IK refer to a substantially open refiner. The solid lines EF, GH and LM refer to a pressurized refiner having a superatmospheric steam pressure of about 140 kPa (corresponding to a temperature of 126° C.) in the beater casing.

The fine lines AB, CD, EF, and GH, respectively, give the range for the respective cases, whereas the heavy lines IK and LM refer to the normal position of the respective maxima.

In view of the specific design of each plant and the specific composition of the raw material employed therein, a precise determination of the optimum chemical lignin softening requires a thorough investigation. When beating is effected in an open refiner in one or two stages, the sulfur content (expressed as wt. % $Na_2SO_3$) of the fiber pulp should lie, depending on the composition of the raw material, within the region ABCD (FIG. 1) defined by the dot-dash lines. When beating is effected in a pressurized refiner in one or two stages, the second stage optionally being carried out in a substantially open refiner, the pulp sulfur content should lie within the region EFGH (FIG. 1) defined and within the boundaries of the solid lines.

DETAILED DESCRIPTION

EXAMPLE 1

Figure 2:
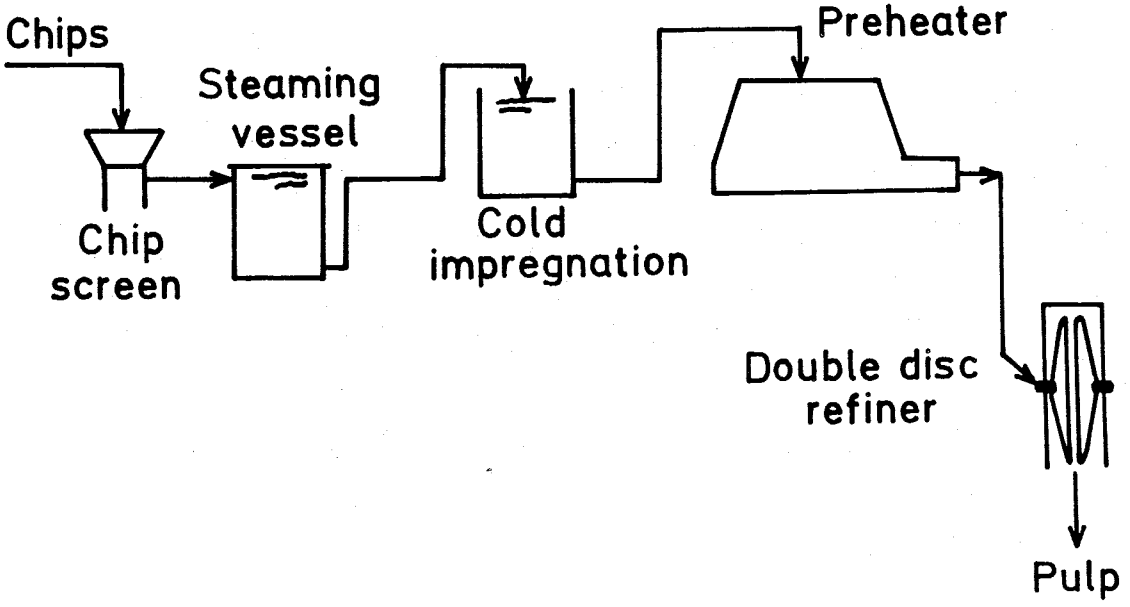
FIG. 2 shows a plant suitable for the production of fiber pulp in accordance with the method of the invention, using a non-pressurized refiner.

Industrial chips from spruce wood were pretreated, defibrated and refined according to the method and in the equipment schematically shown in FIG. 2. In order to obtain different sulfite contents of the wood in the pretreatment step, impregnating solutions with different concentrations of sodium sulfite (cf. Table I) were used. The pH value of the impregnating solution was determined by the sodium sulfite concentration used and was within the range of from 8.2 to 9.0.

Screened chips of conventional size (average dimension 30×15×6 mm) were first steamed with water vapor for 10 min at atmospheric pressure (100° C.). The chips were then immediately immersed in the sulfite impregnating solution. The soaking time was 10 min, and the initial temperature of the solution was about 20° C. The ratio wood to impregnating solution was 1 to 7.5 (w/w).

After drainage, the impregnated chips were subjected to defibration and refining in a conventional thermomechanical pulping stage consisting of a preheater and a double-disc refiner with atmospheric discharge. The preheating was performed with water vapor for 3 min at 126° C. The subsequent defibration and refining was carried out as a two-stage operation at a temperature slightly above 100° C. (non-pressurized refiner) The pulp discharge consistency was 30% after the first stage, and 20% after the second stage. The energy input was 1200 kWh/t in the first refiner stage. In the second stage, the input was varied in such a way that three pulps with different freeness values were obtained, all within the range 250–80 ml Canadian Standard Freeness (ml CSF).

The pulps were characterized according to British Standard. Latency was removed before testing and the shives were determined as Somerville rejects.

The over-all pulp yield was 97% (calculated on the oven dry wood) at the lower sulfite impregnating levels and then gradually decreased to a value of 95% obtained at the highest sulfite impregnating level used.

The uptake of sodium sulfite by the chips in the impregnation step was varied by using solutions of different concentration (cf. Table I, second column). The amount taken up, expressed as per cent by weight $Na_2SO_3$ on the oven dry (o.d.) wood (cf. Table I, sixth column), was calculated from the amount of impregnating solution absorbed by the chips, taking into account the ratio of wood to impregnating solution and the decrease in sodium sulfite concentration in the impregnating bulk solution (cf. Table I, third column). The amount of impregnating solution absorbed by the chips was measured to be about 0.6 kg/kg wood, and could also be calculated from the dry content of the chips determined before and after impregnation (cf. Table I, fourth and fifth columns, respectively).

For example, the dry content of the chips in test No. 6 (cf. Table I) was 44.4% and 35.4% before and after impregnation, respectively. Calculated on the basis of 1 kg oven dry (o.d.) chips, the weight of wet chips was 1/0.444=2.25 kg before and 1/0.354=2.82 kg after impregnation, corresponding to a liquor uptake of 0.57 kg/kg o.d. wood.

TABLE I

| Test No. | Conc of $Na_2SO_3$ in impregnation solution g/kg Before imp. | After imp. | Dry content of chips, wt. % Before imp. | After imp. | Content of $Na_2SO_3$, wt. %, in chips* | Pulp sulfur content, wt. %* | pH in pulp |
|---|---|---|---|---|---|---|---|
| 1 | 0 | 0 | 44.4 | 35.4 | 0 | 0 | 6.0 |
| 2 | 0.41 | 0.35 | 49.4 | 37.0 | — | 0.03 | 5.8 |
| 3 | 1.06 | 0.94 | 44.4 | 35.4 | 0.14 | 0.13 | 6.2 |
| 4 | 1.53 | 1.42 | 49.4 | 37.7 | 0.17 | 0.14 | 6.0 |
| 5 | 2.01 | 1.89 | 44.0 | 34.5 | 0.21 | 0.15 | 6.2 |
| 6 | 2.83 | 2.77 | 44.4 | 35.4 | 0.20 | 0.19 | 6.7 |
| 7 | 4.07 | 3.89 | 44.4 | 35.4 | 0.36 | 0.25 | 6.5 |
| 8 | 6.15 | 5.95 | 44.0 | 34.8 | 0.51 | 0.33 | 6.5 |
| 9 | 7.97 | 7.67 | 44.4 | 35.7 | 0.65 | 0.48 | 6.7 |
| 10 | 7.80 | 7.43 | 44.4 | 35.1 | 0.72 | 0.40 | 6.6 |
| 11 | 10.03 | 9.68 | 44.4 | 34.8 | 0.86 | 0.52 | 6.7 |
| 12 | 12.74 | 12.39 | 44.4 | 35.4 | 0.98 | 0.69 | 6.5 |
| 13 | 15.34 | 14.75 | 44.9 | 35.7 | 1.28 | 0.80 | 6.2 |
| 14 | 16.70 | 15.39 | 44.4 | 35.7 | 1.45 | 0.87 | 6.6 |

*Calculated as percent by weight $Na_2SO_3$ on oven dry chips and pulp, respectively.

The amount of sodium sulfite taken up by penetration is thus 2.83 (g/kg)×0.57=1.61 g $Na_2SO_3$/kg o.d. wood. The amount taken up by diffusion can be calculated from the decrease in concentration of the impregnating solution, 2.83−2.77=0.06 (g/kg), times the amount of bulk solution corresponding to 1 kg o.d. wood, i.e. 7.5-0.57=6.93 kg, where 7.5 is the ratio of impregnating solution to wood. The total amount of sodium sulfite taken up is then 1.61+0.06×6.93=1.61+0.41=2.0 g $Na_2SO_3$/kg o.d. wood or 0.20 wt. % $Na_2SO_3$. Starting from a given content of sodium sulfite in the chips, the concentration wanted in the impregnating solution can easily be calculated, knowing the parameters involved.

The sulfur content in the pulp, expressed as per cent by weight $Na_2SO_3$ on the oven dry (o.d.) pulp, was determined by chemical analysis. A pulp sample (300 mg) was combusted according to Schöniger [cf. Schöniger, W.: Mikrochimica Acta (Vienna) (1955):1, 123; ibid. (1956):4–6, 869] and the combustion gases absorbed in sodium nitrite solution (2 g/l). After adsorption, the excess of oxidant was destroyed by boiling. The amount of sulfate ions obtained was determined by potentiometric titration with 0.001M $Pb(ClO_4)_2$ in aqueous ethanol (80%), using a lead ion selective electrode.

This method of analysis can also be used to determine the sulfur content in wood chips. In such a case, the dried chips are sliced into small pieces before combustion.

The sulfur contents, the properties, and the energy requirements of the pulps produced appear from Tables I–III and FIGS. 3–9.

Figure 3:
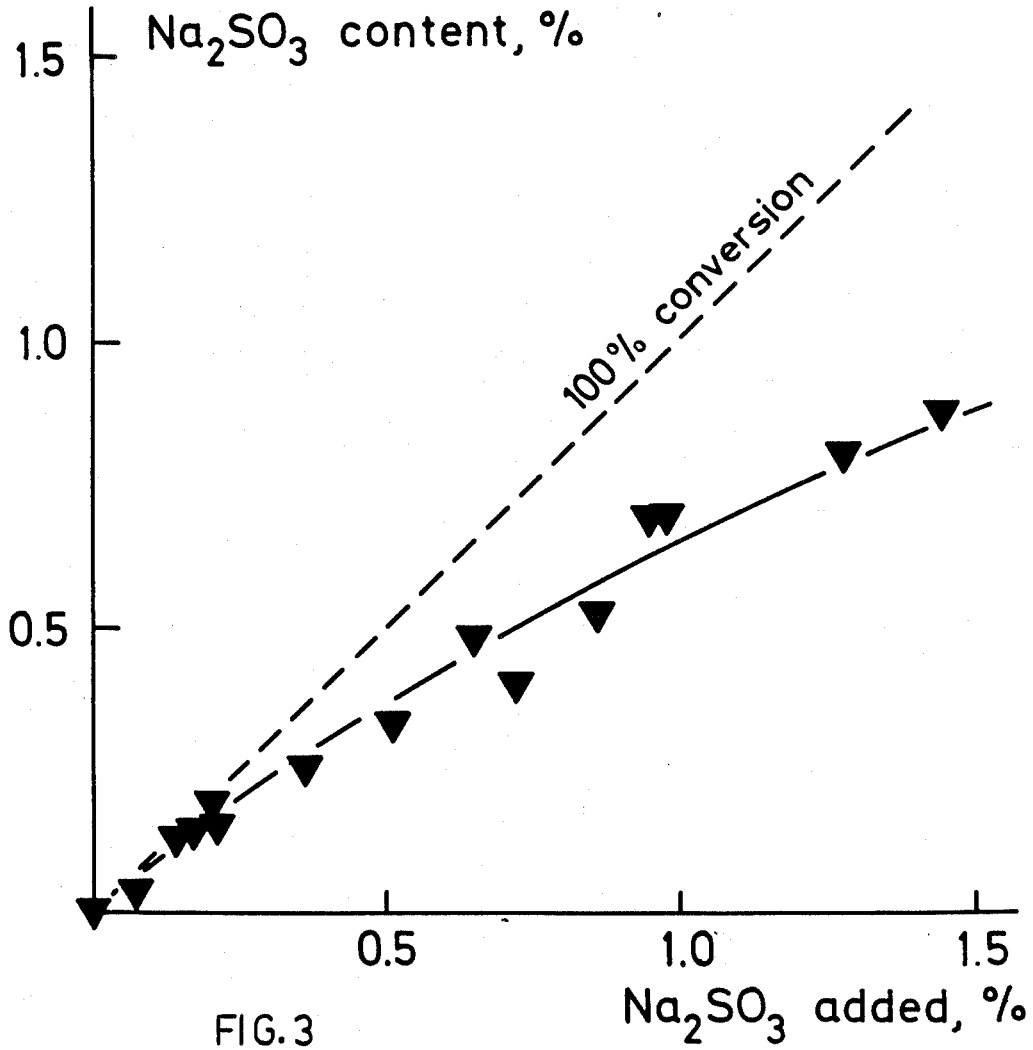
FIGS. 3–9 show the results obtained in a first illustrative Example.

FIG. 3 and Table I (sixth and seventh columns) show the pulp sulfur content (expressed as wt. % $Na_2SO_3$ on o.d. pulp) as a function of the sulfite added (expressed as wt. % $Na_2SO_3$ on o.d. wood). As can be seen, a very high conversion of sodium sulfite was obtained, especially at very low additions. After refining, a fraction amounting to 90–98% of the total pulp sulfur content determined was found to be chemically bonded to the pulp, the higher percentage corresponding to a low, optimum impregnating level. The amount of pulp sulfur chemically bonded to the pulp was taken as the amount determined after washing of the pulp with pure water, the wash water being recirculated to avoid losses of fine material.

The results show that only small amounts of unreacted sulfite, if any, are present in the pulp after refining. This is beneficial with respect to the consumption of hydrogen peroxide in a subsequent bleaching step and eliminates the need of a separate sulfite recovery system.

Figure 4:
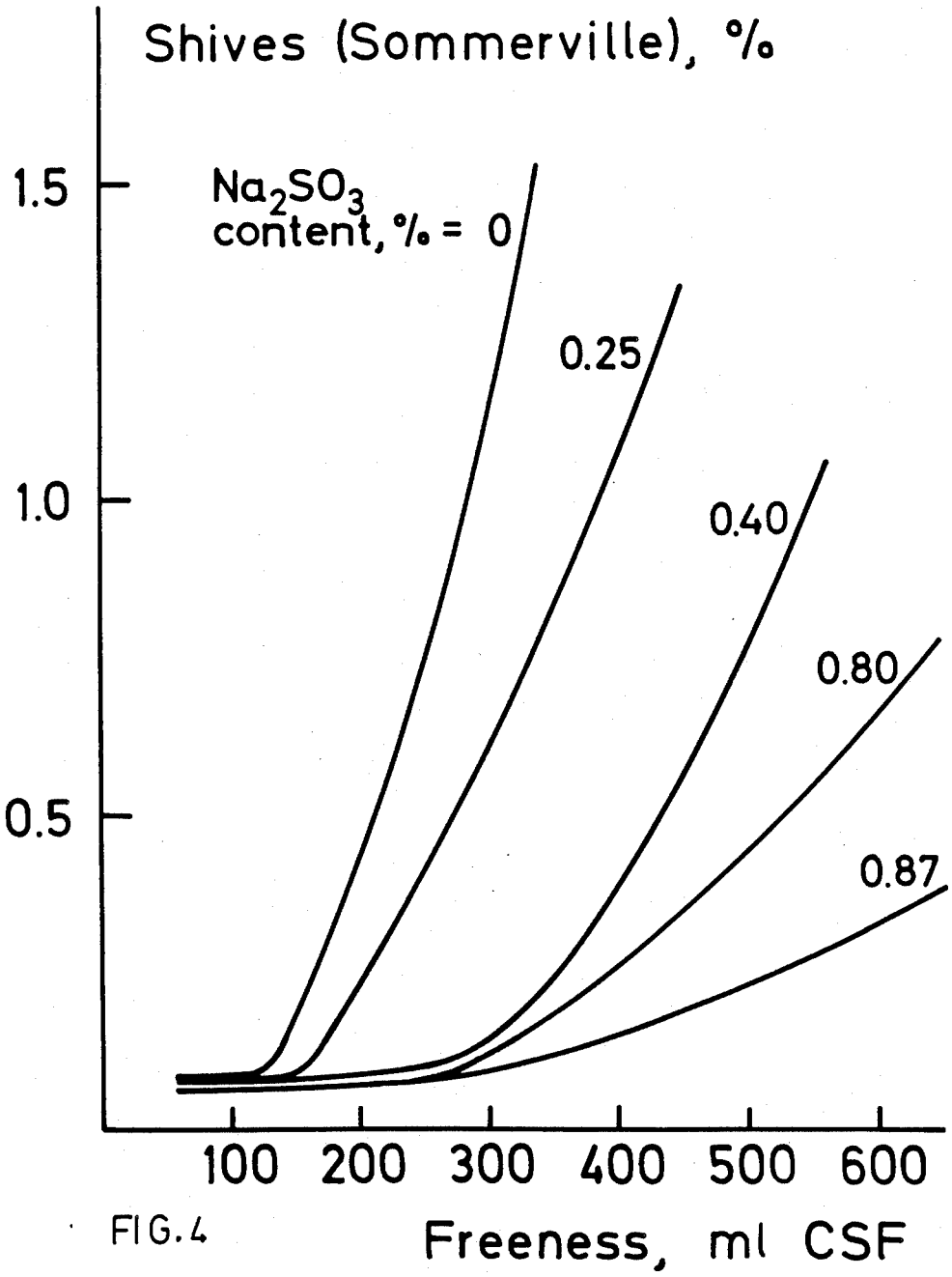

FIG. 4 shows the shives content (determined as Somerville shives, %) for pulps with different sulfur contents (expressed as wt. % $Na_2SO_3$ on o.d. pulp) as a function of the drainability (expressed as ml CSF, Canadian Standard Freeness).

Figure 5:
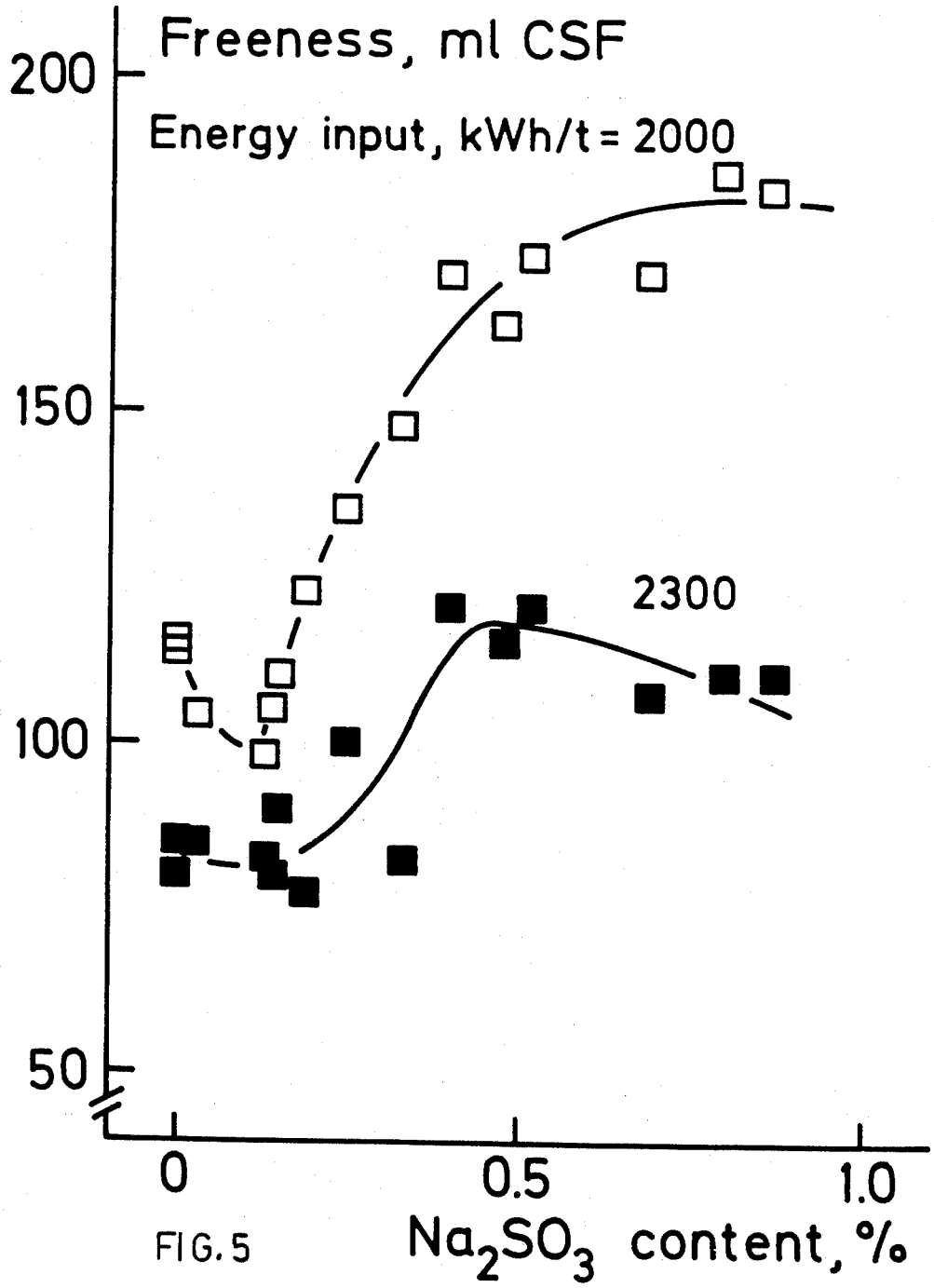

FIG. 5 and Table II (third and fourth columns) show the drainability (ml CSF) at different energy inputs as a function of the pulp sulfur content (expressed as wt. % $Na_2SO_3$ on o.d. pulp). At the lower energy input (2000 kWh/t), the effect of the sulfite treatment was considerable with a rapid increase in freeness with increased pulp sulfur content above about 0.2%. At low sulfur content, an unexpected minimum was found, which indicates that this pulp was more easily refined. At the higher energy input, the influence of the sulfur content decreased. The maximum in freeness obtained at a sulfur content of 0.4–0.5% shows that a pretreatment resulting in this sulfur content level is unfavorable when good pulp properties are to be achieved at a reasonable energy input.

Figure 6:
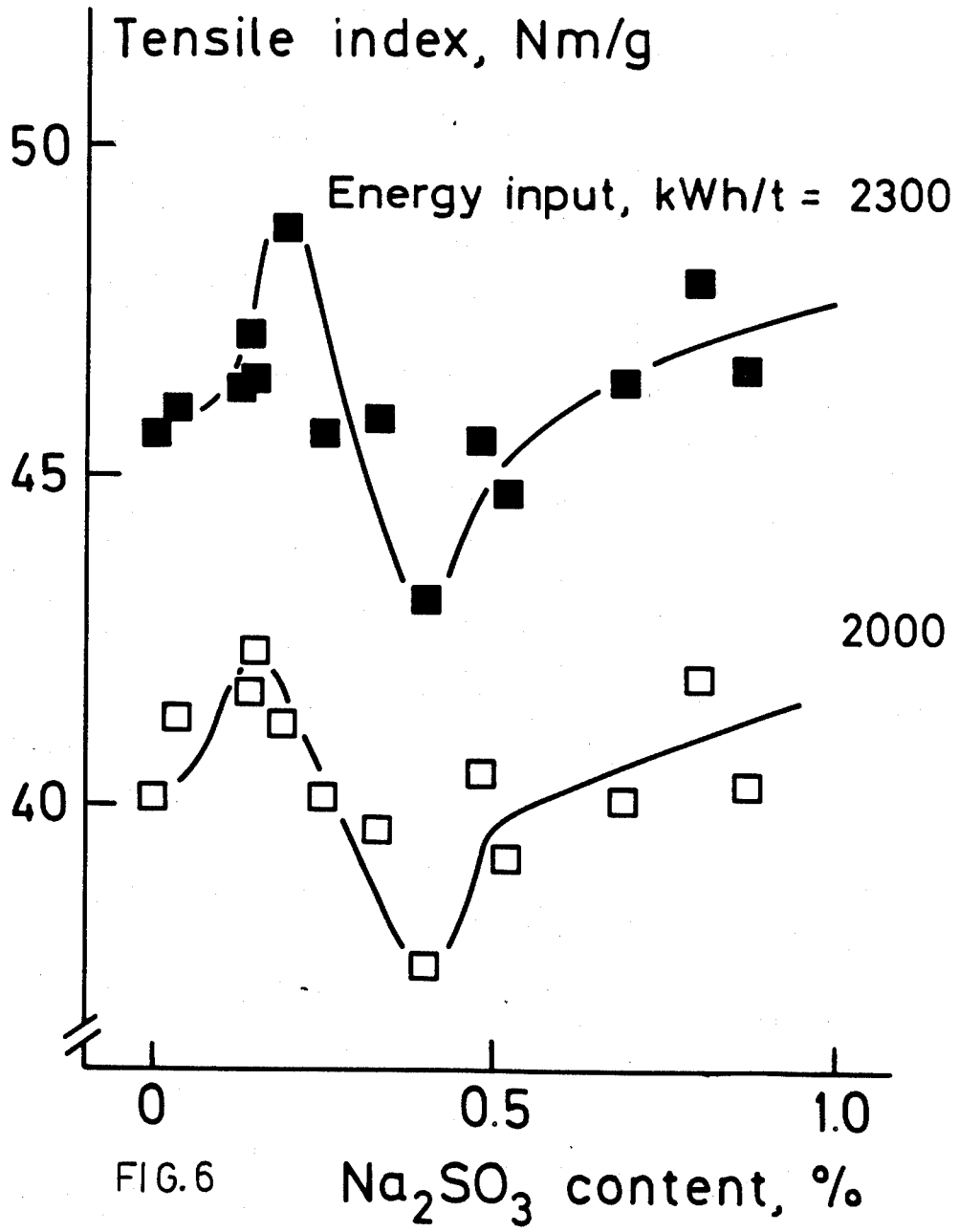

FIG. 6 and Table III show the tensile index (Nm/g) at different energy inputs as a function of the pulp sulfur content (expressed as wt. % $Na_2SO_3$ on o.d. pulp). As can be seen, an increase in pulp sulfur content from zero results in an increased tensile index up to a maximum at a certain low pulp sulfur content (about 0.2% expressed as wt. % $Na_2SO_3$ equivalent to about 0.05% expressed as wt. % S) referred to as optimum condition in the instant application. A further increase in the pulp sulfur content then results, however, in a rapid decrease in tensile strength until a clear minimum is reached. The presence of a local maximum followed by a minimum is an unexpected and non-obvious condition which has not been reported earlier.

TABLE II

| Test No. | Pulp sulfur content as wt. % $Na_2SO_3$ | Freeness, ml CSF 2000 kWh/t | 2300 kWh/t | Light scattering coeff. $m^2$/kg 2000 kWh/t | 2300 kWh/t | Energy input, kWh/t 130 ml CSF | 100 ml CSF |
|---|---|---|---|---|---|---|---|
| 1 | 0 | 115 | 83 | 53.4 | 57.8 | 1890 | 2120 |
| 2 | 0.03 | 104 | 85 | — | — | 1800 | 2050 |

TABLE II-continued

| Test No. | Pulp sulfur content as wt. % $Na_2SO_3$ | Freeness, ml CSF 2000 kWh/t | Freeness, ml CSF 2300 kWh/t | Light scattering coeff. $m^2/kg$ 2000 kWh/t | Light scattering coeff. $m^2/kg$ 2300 kWh/t | Energy input, kWh/t 130 ml CSF | Energy input, kWh/t 100 ml CSF |
|---|---|---|---|---|---|---|---|
| 3 | 0.13 | 98 | 82 | 56.7 | 60.6 | 1740 | 1960 |
| 4 | 0.14 | 105 | 80 | — | — | 1800 | 2050 |
| 5 | 0.15 | 110 | 90 | 56.0 | 59.6 | 1850 | 2100 |
| 6 | 0.19 | 123 | 78 | 54.3 | 60.0 | 1960 | 2130 |
| 7 | 0.25 | 135 | 100 | 53.8 | 57.4 | 2035 | 2310 |
| 8 | 0.33 | 147 | 83 | 52.0 | 56.6 | 2080 | 2220 |
| 9 | 0.48 | 163 | 115 | — | — | 2190 | 2400 |
| 10 | 0.40 | 170 | 120 | 51.2 | 55.7 | 2230 | 2440 |
| 11 | 0.52 | 173 | 120 | 49.1 | 51.9 | 2230 | 2470 |
| 12 | 0.69 | 170 | 107 | 49.5 | 51.3 | 2220 | 2380 |
| 13 | 0.80 | 185 | 110 | — | 51.9 | 2210 | 2350 |
| 14 | 0.87 | 183 | 110 | — | — | 2180 | 2370 |

TABLE III

| Test No. | Pulp sulfur content, wt. % $Na_2SO_3$ | Tensile index, Nm/g, at energy input of 1900 kWh/t | 2000 | 2200 | 2300 |
|---|---|---|---|---|---|
| 1 | 0 | 38.2 | 40.1 | 43.7 | 45.6 |
| 2 | 0.03 | — | 41.3 | — | 46.0 |
| 3 | 0.13 | 39.0 | — | 44.5 | 46.3 |
| 4 | 0.14 | — | 41.7 | — | 47.1 |
| 5 | 0.15 | 41.5 | 42.3 | 45.0 | 46.4 |
| 6 | 0.19 | 38.2 | 41.2 | 48.1 | 48.7 |
| 7 | 0.25 | 38.0 | 40.1 | 43.7 | 45.6 |
| 8 | 0.33 | 36.2 | 39.6 | 44.4 | 45.8 |
| 9 | 0.48 | — | 40.5 | — | 45.5 |
| 10 | 0.40 | 36.3 | 37.6 | 41.0 | 43.1 |
| 11 | 0.52 | 37.3 | 39.2 | 42.1 | 44.7 |
| 12 | 0.69 | 38.3 | 40.1 | 44.1 | 46.4 |
| 13 | 0.80 | 38.3 | 41.9 | 44.0 | 47.9 |
| 14 | 0.87 | 38.9 | 40.3 | 44.0 | 46.6 |

Such a high tensile index as found at optimum condition was not obtained at the higher impregnating levels used, although extended to 1.5 wt. % $Na_2SO_3$ on o.d. wood (cf. Tables III and I).

The shape of the tensile index curve was not dependent on the energy input, although a lower energy input resulted, as expected, in lower absolute values of the tensile index.

Figure 7:
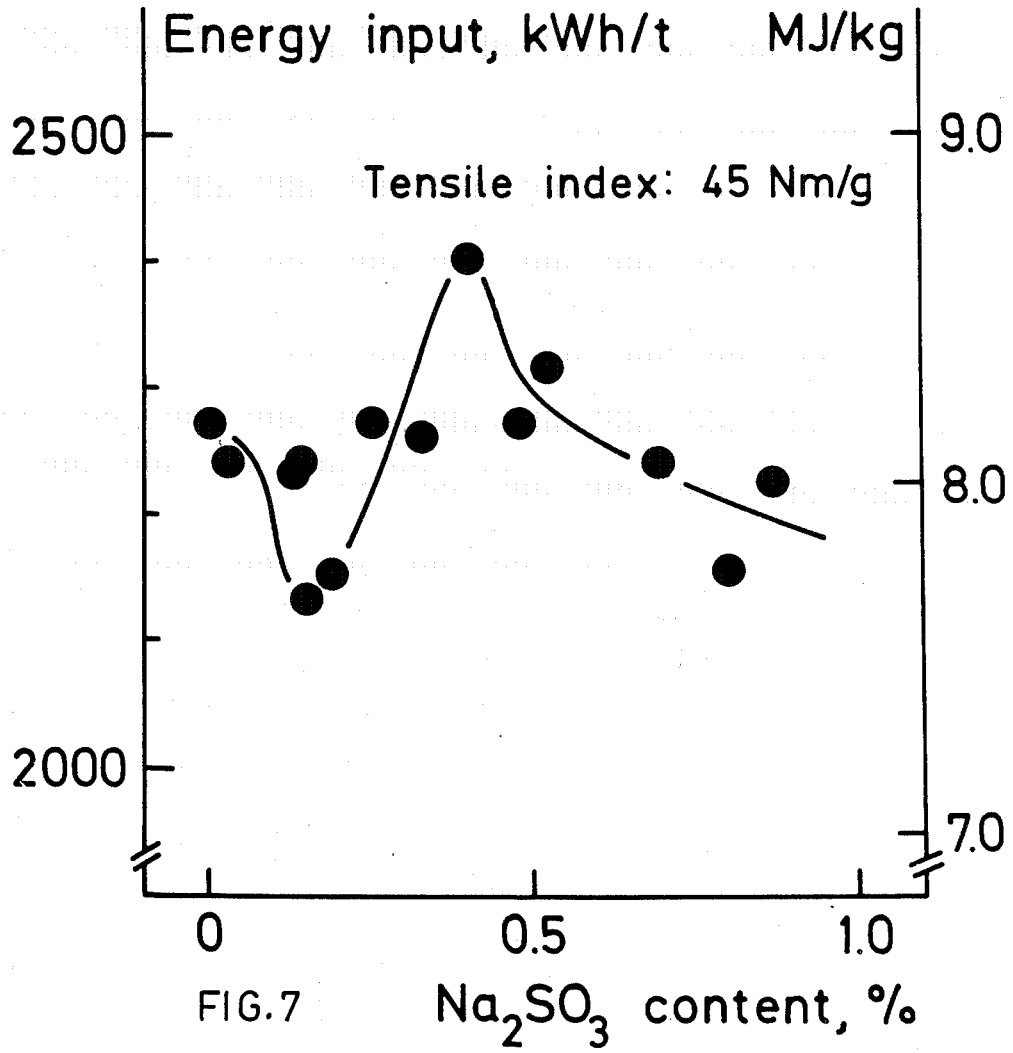

FIG. 7 shows the energy input (kWh/t) required to obtain a tensile index of 45 Nm/g as a function of the pulp sulfur content (expressed as wt. % $Na_2SO_3$ on o.d. pulp). A comparison of the curves given in FIGS. 6 and 7 shows that the latter curve is a mirror representation of the former. The energy requirement at low, optimum sulfur content is much lower than for the reference thermomechanical pulp containing no sulfur.

Figure 8:
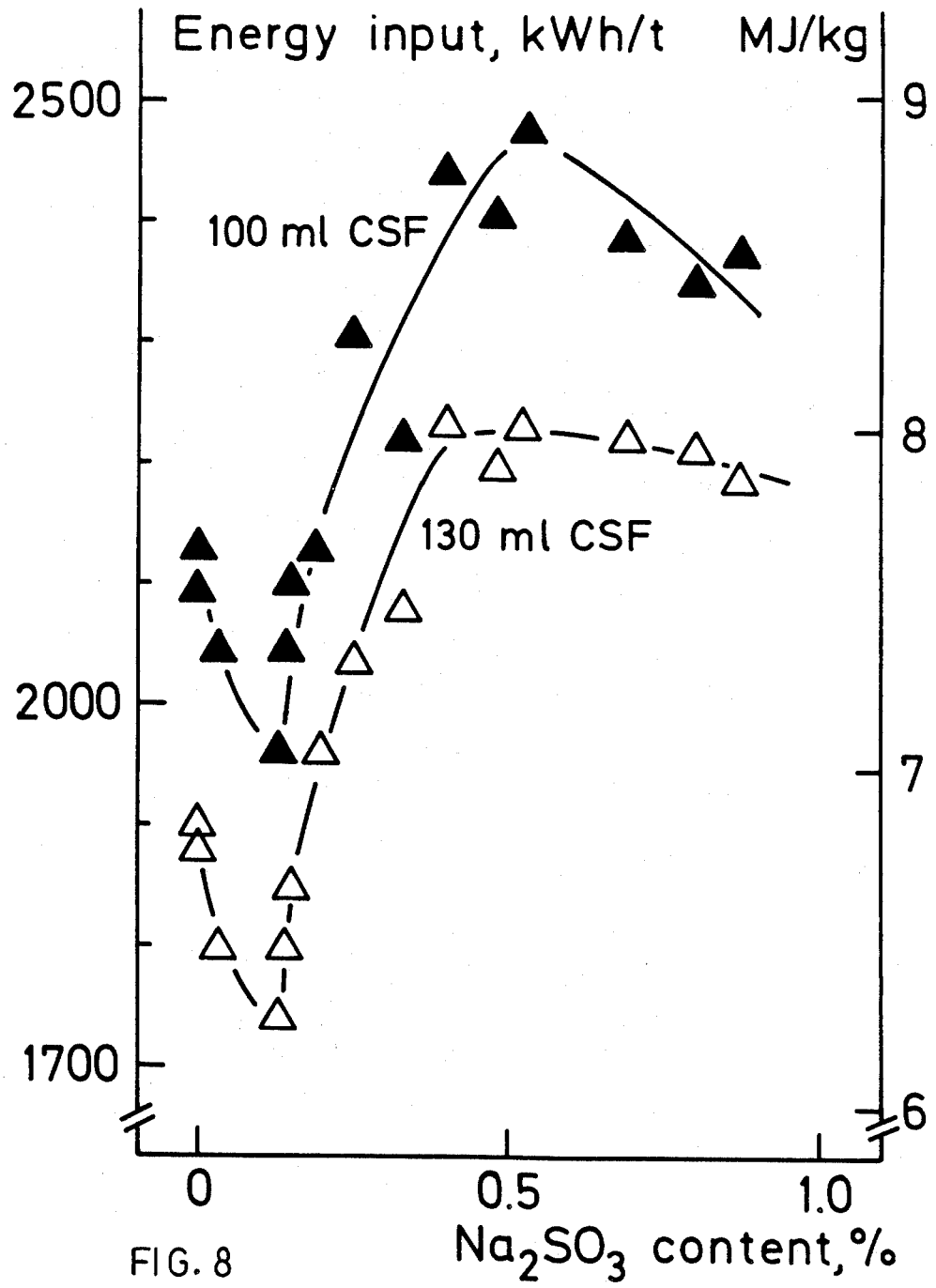

FIG. 8 and Table II (seventh and eighth columns) show the energy input (kWh/t) required to obtain a drainability of 130 and 100 ml CSF (Canadian Standard Freeness), respectively, as a function of the pulp sulfur content (expressed as wt. % $Na_2SO_3$ on o.d. pulp). The minimum appearing at low pulp sulfur content was significant for pulps with freeness values up to 250 ml CSF and the energy requirement was lower than that of the reference pulp. These findings are unexpected since the literature teaches that addition of sulfite leads to an increased energy requirement.

Figure 9:
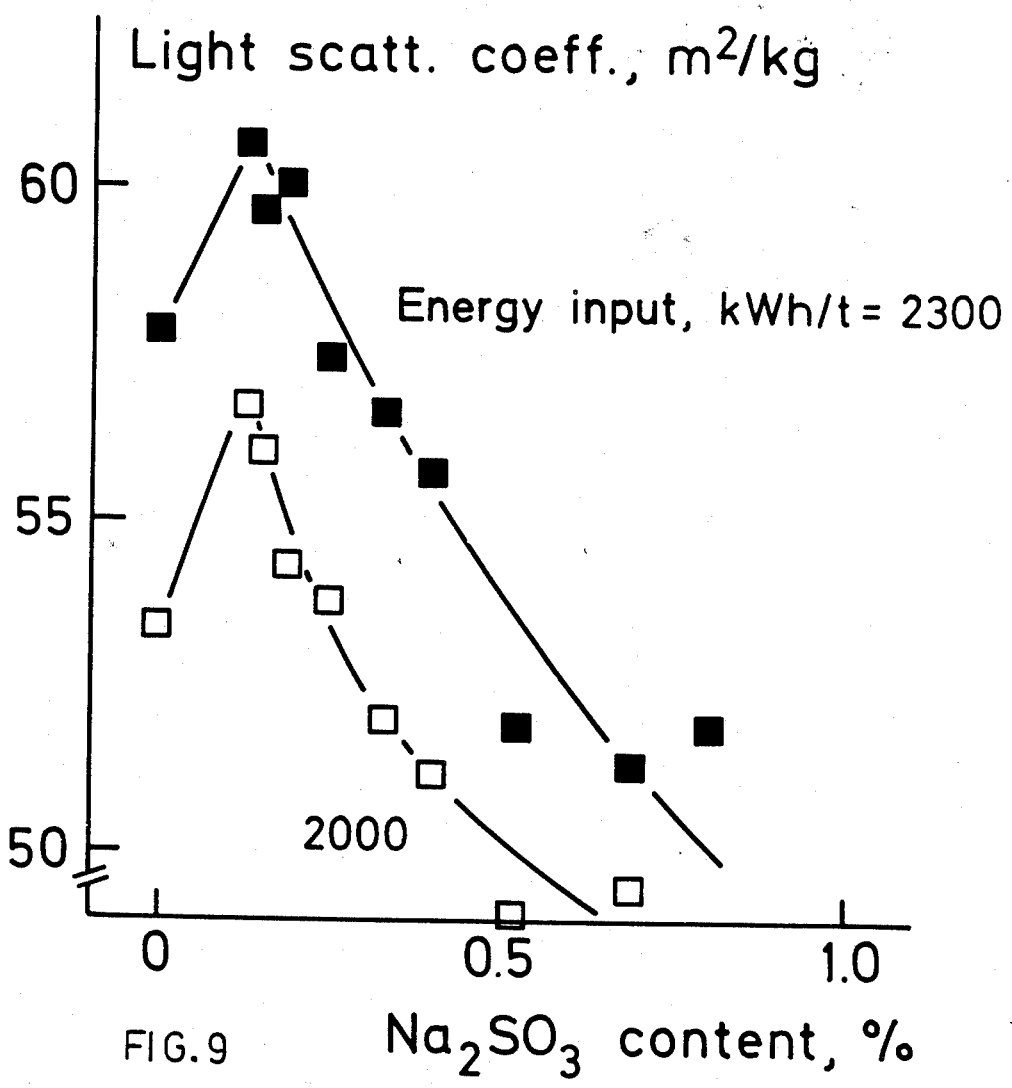

FIG. 9 and Table II (fifth and sixth columns) show the light scattering coefficient ($m^2/kg$) at different energy inputs as a function of the pulp sulfur content (expressed as wt. % $Na_2SO_3$ on o.d. pulp). The positive effects found at low, optimum pulp sulfur content also included the light scattering coefficient which, unexpectedly, showed a maximum value.

The ISO-brightness of the pulps was within the range 63 (reference pulp) to 66%.

EXAMPLE 2

Screened chips of conventional size of spruce and pine wood were mixed with the composition 80 wt. % spruce and 20 wt. % pine. The mixture was pretreated and refined according to the procedure described in Example 1. The pulp discharge consistency was 30% after the first refiner stage and 20% after the second. The energy input was 1300 kWh/t in the first stage. In the second stage, the input was varied in such a way that three pulps with different freeness values were obtained, all within the range of 335–75 ml Canadian Standard Freeness (ml CSF). The pulps were analyzed as described in Example 1.

The over-all pulp yield was 96% (calculated on the o.d. wood) at the lower sulfite impregnating levels used, and decreased to about 94% for the pulp with the highest sulfur content (test No. 26, Table IV).

The concentrations of the impregnating solutions used and the contents obtained in the wood chips and in the pulps are given in Table IV, all calculations and analyses being made as described in Example 1. The sulfur contents and the properties of the pulps produced appear from Tables IV–V and FIGS. 10–12.

TABLE IV

| Test No. | Conc of $Na_2SO_3$ in impregnation solution g/kg Before imp. | After imp. | Dry content of chips, wt. % Before imp. | After imp. | Content of $Na_2SO_3$, wt. %, in chips* | Pulp sulfur content, wt. %* | pH in pulp |
|---|---|---|---|---|---|---|---|
| 15 | 0 | 0 | 44.4 | 35.1 | 0 | 0 | 5.7 |
| 16 | 0.94 | 0.83 | 44.4 | 35.7 | 0.13 | 0.125 | 6.0 |
| 17 | 2.48 | 2.30 | 47.1 | 36.0 | 0.29 | 0.21 | 6.0 |
| 18 | 5.90 | 5.72 | 43.5 | 34.8 | 0.46 | 0.39 | 6.2 |
| 19 | 7.43 | 7.40 | 47.1 | 37.0 | 0.59 | 0.46 | 6.3 |
| 20 | 8.26 | 8.02 | 44.0 | 35.7 | 0.61 | 0.49 | 6.5 |
| 21 | 10.09 | 9.85 | 43.5 | 34.8 | 0.74 | 0.56 | 6.4 |
| 22 | 11.45 | 10.86 | 44.0 | 35.4 | 1.04 | 0.67 | 6.3 |
| 23 | 11.68 | 11.45 | 47.1 | 36.7 | 0.86 | 0.76 | 6.2 |
| 24 | 12.21 | 11.86 | 43.0 | 33.1 | 1.08 | 0.76 | 6.4 |

TABLE IV-continued

| Test No. | Conc of $Na_2SO_3$ in impregnation solution g/kg Before imp. | After imp. | Dry content of chips, wt. % Before imp. | After imp. | Content of $Na_2SO_3$, wt. %, in chips* | Pulp sulfur content, wt. %* | pH in pulp |
|---|---|---|---|---|---|---|---|
| 25 | 15.93 | 15.34 | 48.2 | 37.4 | 1.37 | 0.88 | 6.2 |
| 26 | 20.12 | 19.77 | 47.1 | 35.7 | 1.61 | 1.11 | 6.1 |

*Calculated as percent by weight $Na_2SO_3$ on oven dry chips and pulp, respectively.

TABLE V

| Test No. | Pulp sulfur content, wt. % $Na_2SO_3$ | Freeness, ml CSF 2300 kWh/t | 2500 kWh/t | Tensile index, Nm/g, at energy input of 1900 | 2100 | 2300 | 2500 kWh/t |
|---|---|---|---|---|---|---|---|
| 15 | 0 | 95 | 70 | 33.6 | 36.2 | 38.8 | 41.4 |
| 16 | 0.13 | 70 | 50 | 36.7 | 39.5 | 42.4 | 45.2 |
| 17 | 0.21 | 94 | 77 | 39.0 | 41.7 | 44.3 | 46.9 |
| 18 | 0.39 | 104 | 72 | 35.8 | 40.7 | 43.7 | 47.6 |
| 19 | 0.46 | 103 | 87 | 37.8 | 41.3 | 44.8 | 48.4 |
| 20 | 0.49 | 105 | 92 | 36.1 | 39.6 | 43.0 | 46.5 |
| 21 | 0.56 | 117 | 92 | 33.4 | 36.9 | 40.5 | 44.0 |
| 22 | 0.67 | 143 | 110 | 34.9 | 38.3 | 41.7 | 45.1 |
| 23 | 0.76 | 148 | 106 | 34.0 | 37.5 | 41.0 | 44.4 |
| 24 | 0.76 | 137 | 100 | 35.6 | 38.9 | 42.2 | 45.5 |
| 25 | 0.88 | 167 | 132 | 33.5 | 37.3 | 41.1 | 44.9 |
| 26 | 1.11 | 190 | 145 | 33.7 | 37.6 | 41.5 | 45.4 |

Figure 10:
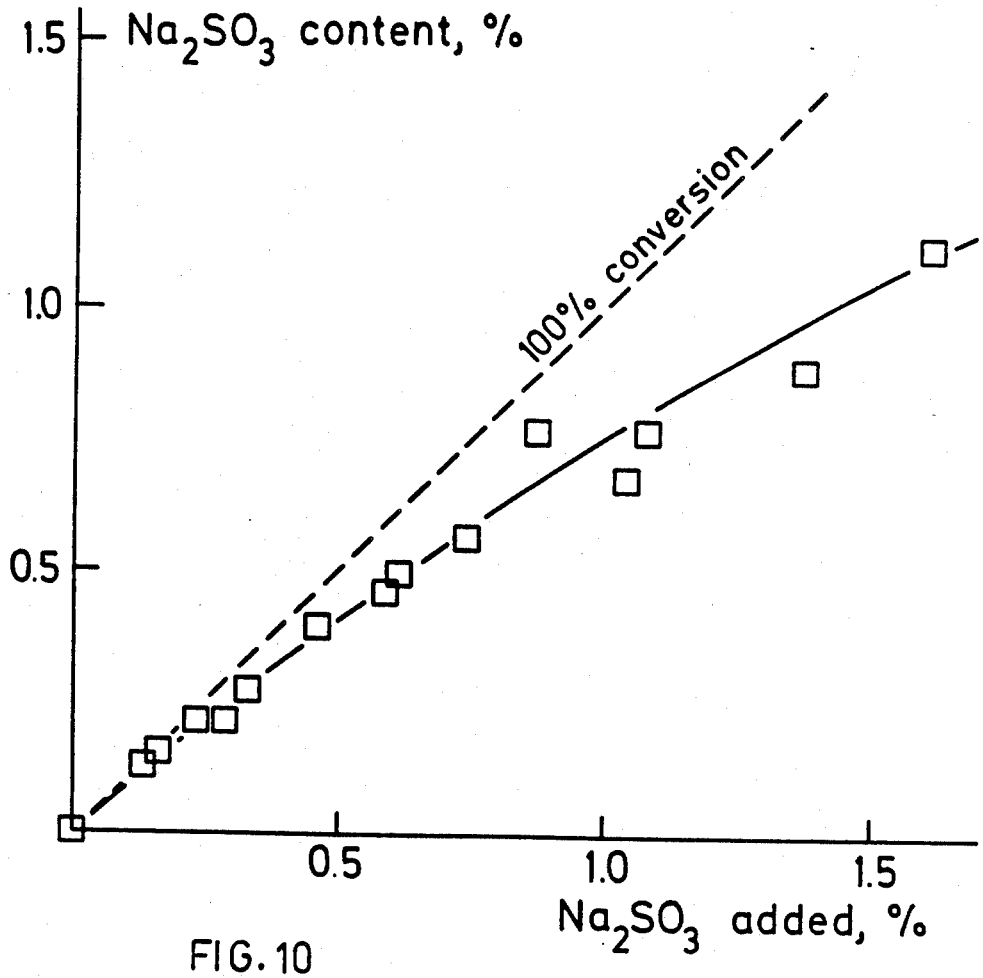
FIGS. 10–12 show the results obtained in a second illustrative Example.

FIG. 10 and Table IV (sixth and seventh columns) show the pulp sulfur content (expressed as wt. % $Na_2SO_3$ on o.d. pulp) as a function of the sulfite added (expressed as wt. % $Na_2SO_3$ on o.d. wood). The pretreatment used which included atmospheric steaming at 100° C. (10 min) and a subsequent impregnation (initial temperature 20° C., 10 min) resulted also in the case of the softwood mixture in a very thorough impregnation. As a result, a very high utilization of the added sodium sulfite was obtained, especially at very low impregnating levels, and the conversion to chemically bonded sulfur was slightly higher than that obtained for pure spruce wood (cf. Example 1). Our present theory is that these findings may be explained by a higher accessibility of the pine wood to the chemicals compared to that of spruce wood. In pine wood, there are window-like pits between the ray parenchyma cells and the longitudinal tracheids, as well as a comparatively high proportion of ray-tracheids. This results in an improved penetration. Furthermore, the ray parenchyma cells in pine communicate with each other through pit membranes with a comparatively large surface area, which facilitates radial penetration. Pit aspiration is also considered to be less pronounced in the case of pine wood.

Figure 11:
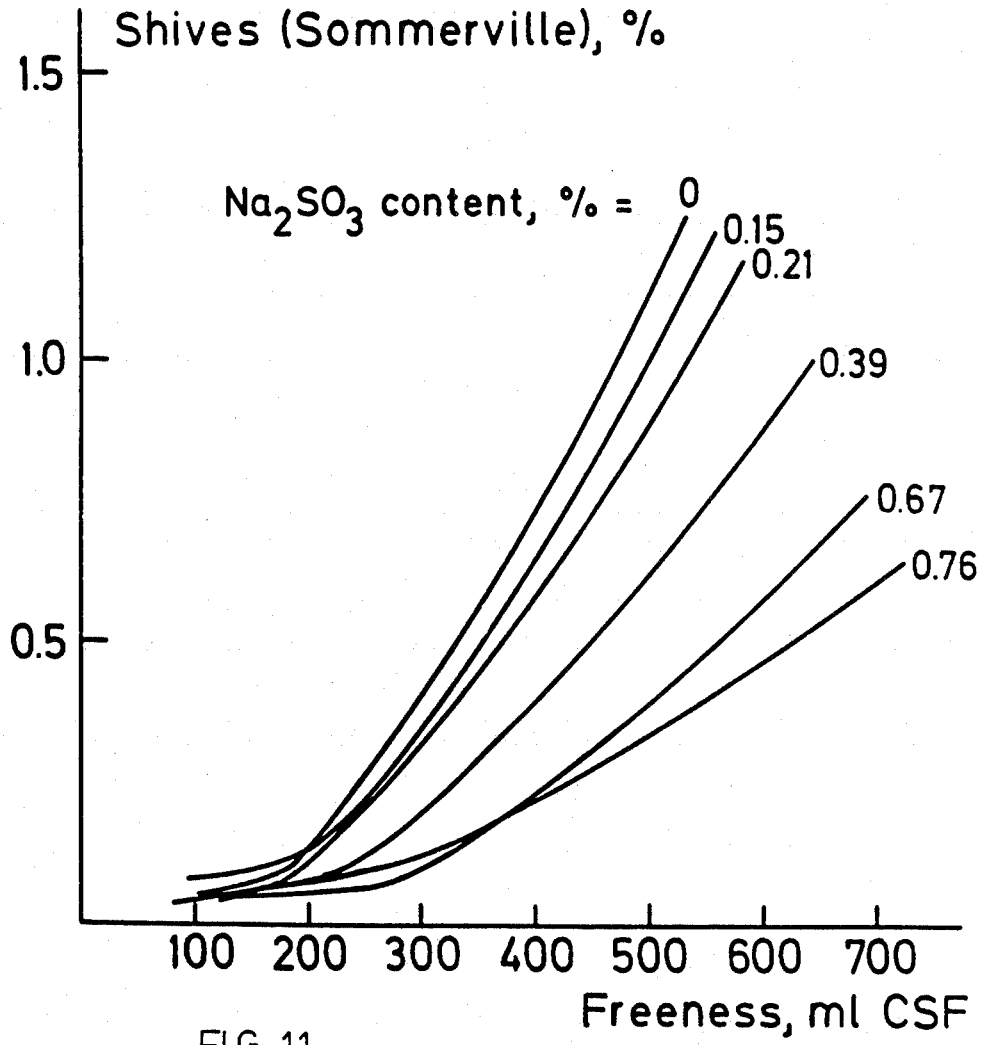

FIG. 11 shows the shives content (determined as Somerville shives, %) for pulps with different pulp sulfur contents (expressed as wt. % $Na_2SO_3$ on o.d. pulp) as a function of the drainability (ml CSF).

Figure 12:
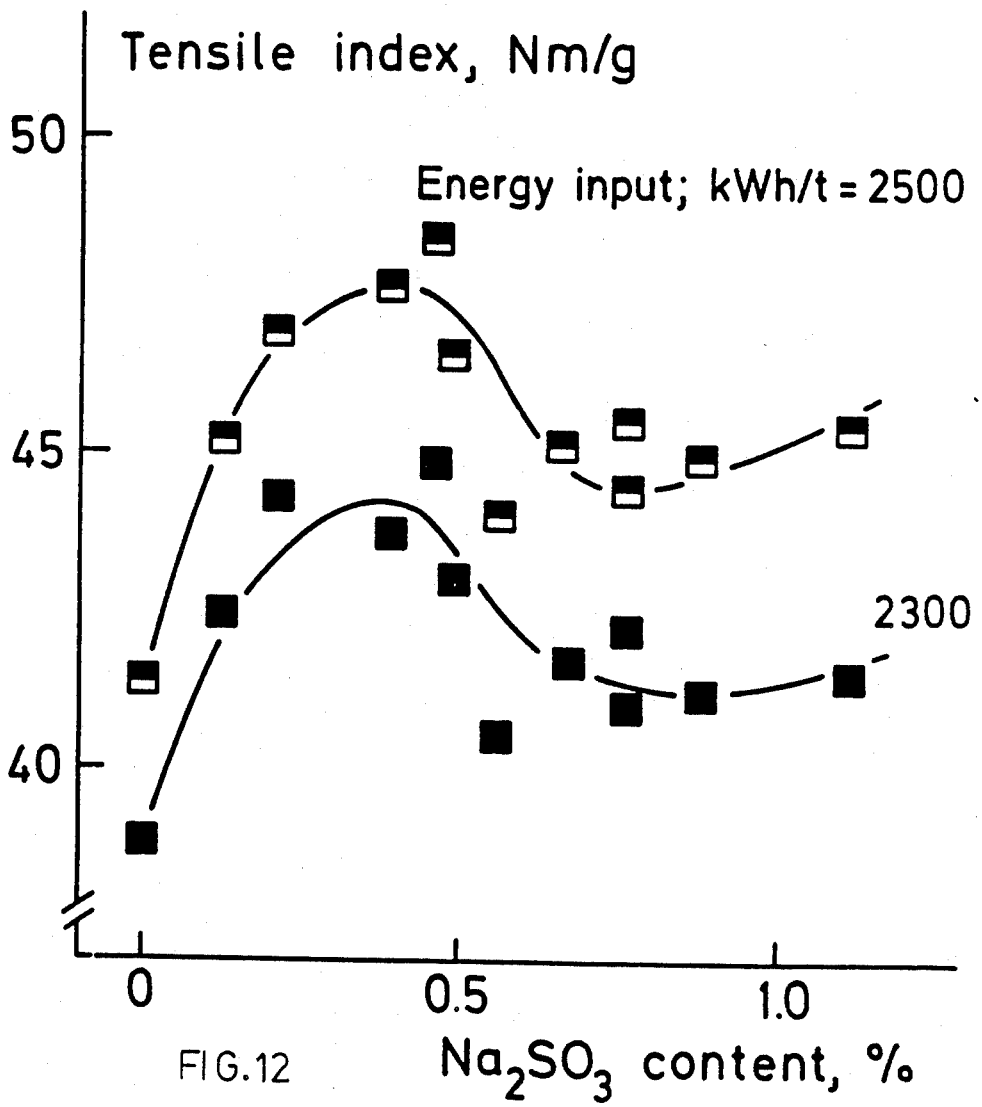

FIG. 12 and Table V (fifth to eighth columns) show the tensile index (Nm/g) at different energy inputs as a function of the pulp sulfur content (expressed as wt. % $Na_2SO_3$ on o.d. pulp). The tensile index curves show a clear maximum and a minimum at about 0.4% and 0.8% sulfur content, respectively. The shape of the curve is very much the same as that found in the case of pure spruce wood (Example 1), although the maximum and minimum in the case of pure spruce appeared at sulfur contents of about 0.2% and 0.4%, respectively. The high tensile index values obtained at low pulp sulfur content (about 0.4%), referred to as optimum condition for the softwood mixture containing 80% spruce in the instant application, could not be regained even at the higher impregnating levels investigated. A severe chemical treatment with a high degree of lignin sulfonation seems instead to be required. The over-all pulp yield would then most probably be adversely affected.

EXAMPLE 3

Industrial chips from spruce and pine wood in a relationship of 85 wt. % spruce and 15 wt. % pine were treated with dilute sodium sulfite solutions with different concentrations of sulfite and pH value 8.2–9.5 in order to obtain the different sodium sulfite contents in the chips given in Table VI (second column).

TABLE VI

| Test No. | Content of $Na_2SO_3$, wt. %, in chips* | Pulp sulfur content, wt. %* | pH in pulp | Tensile index, Nm/g, at energy input of 1600 | 1700 kWh/t | Light scattering coeff., $m^2/kg$ |
|---|---|---|---|---|---|---|
| 27 | 0 | 0 | 4.7 | 21.0 | 22.6 | 44.1 |
| 28 | 0.16 | 0.13 | 4.7 | 24.3 | 26.2 | 48.0 |
| 29 | 0.40 | 0.21 | 5.3 | 23.5 | 27.5 | 44.1 |
| 30 | 0.44 | 0.32 | 5.7 | 23.2 | 25.4 | — |
| 31 | 0.52 | 0.35 | 5.6 | 22.3 | 24.4 | 43.3 |

*Calculated as percent by weight $Na_2SO_3$ on oven dry chips and pulp, respectively.

The softwood chips were steamed for 10 min with water vapor at atmospheric pressure (100° C.) Sulfite solution was sprayed over the chips at the inlet to the steaming vessel. After steaming, the chips were immediately dropped into a chip washer, resulting in an uptake of sulfite containing washing water in the wood structure due to steam condensation within the chips. A material balance in the impregnation system, taking into account the loss of sulfite in the overflow of washing water and the amount of impregnating liquor absorbed by the chips, gave the amount of sulfite taken up (calculated as per cent by weight $Na_2SO_3$ on o.d. wood).

After impregnation and dewatering, the chips were delivered by metering screws to a conventional thermomechanical pulping stage consisting of a preheater (126° C., 3 min) and, in this illustrative Example, a pressurized, first-stage refiner. The defibration and initial refining achieved in this refiner stage were carried out at a temperature of or slightly above 126° C., corresponding to a measured superatmospheric pressure in the beater casing of about 140 kPa (kilo Pascal). The energy input averaged 1240 kWh/t and the pulp discharge consistency was 40%.

The pulp produced in the pressurized, first-stage was then further refined in an open second-stage refiner at a temperature slightly above 100° C. The pulp discharge consistency was 20% after the second stage. The pulp production averaged 11.7 tons/h during the run.

The pulps were characterized according to SCAN methods and otherwise treated and analyzed as described in Example 1.

The sulfur contents, the properties, and the energy requirements of the pulps produced appear from Table VI and FIGS. 13–16.

Figure 13:
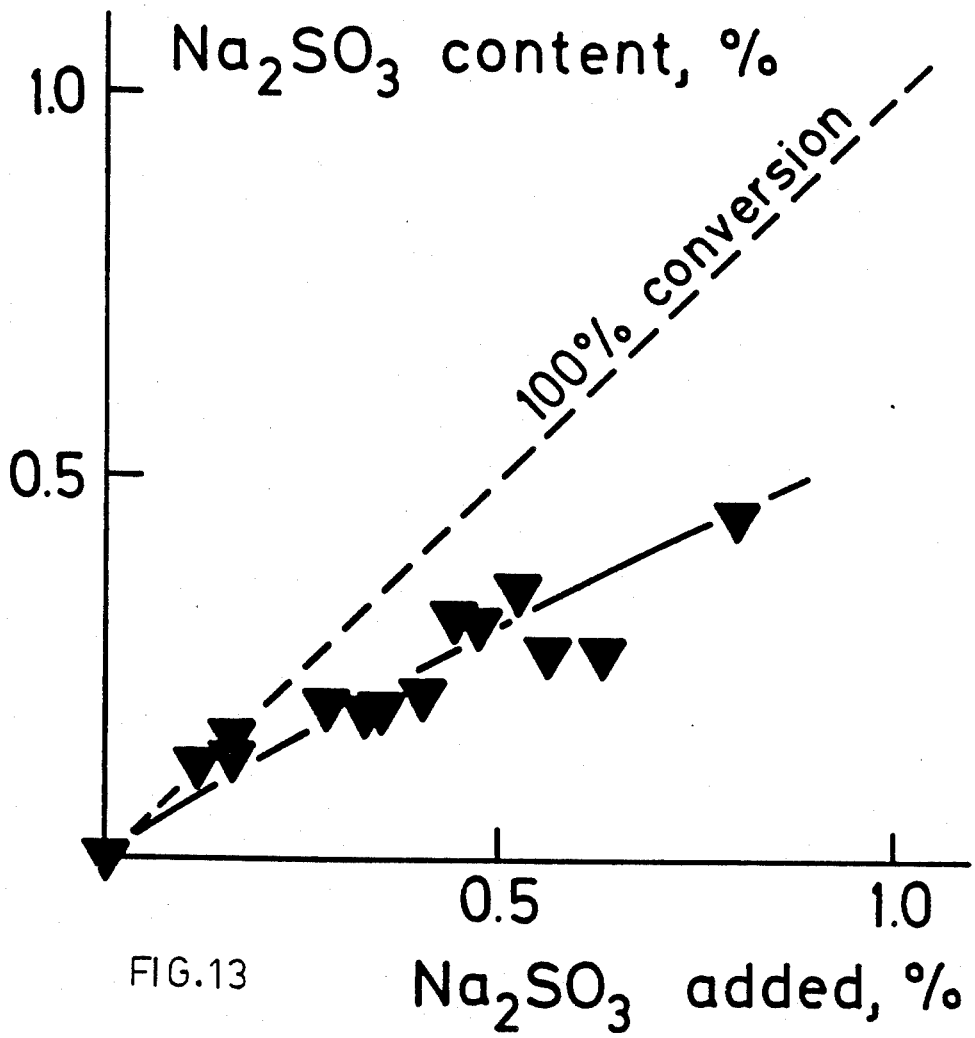
FIGS. 13–16 show the results obtained in a third illustrative Example.

FIG. 13 and Table VI (second and third columns) show the pulp sulfur content (expressed as wt. % $Na_2SO_3$ on o.d. pulp) as a function of the sulfite added (expressed as wt. % $Na_2SO_3$ on o.d. wood). As can be seen, a high conversion of added sulfite was obtained at low sulfite impregnating levels. The pulp sulfur analyses also showed that more than 95% of the total pulp sulfur determined were chemically bonded to the pulp and could not be removed by repeated washing with pure water. Thus, at low optimum impregnating levels, very small amounts, if any, of unreacted sulfite are present in the final pulp.

Figure 14:
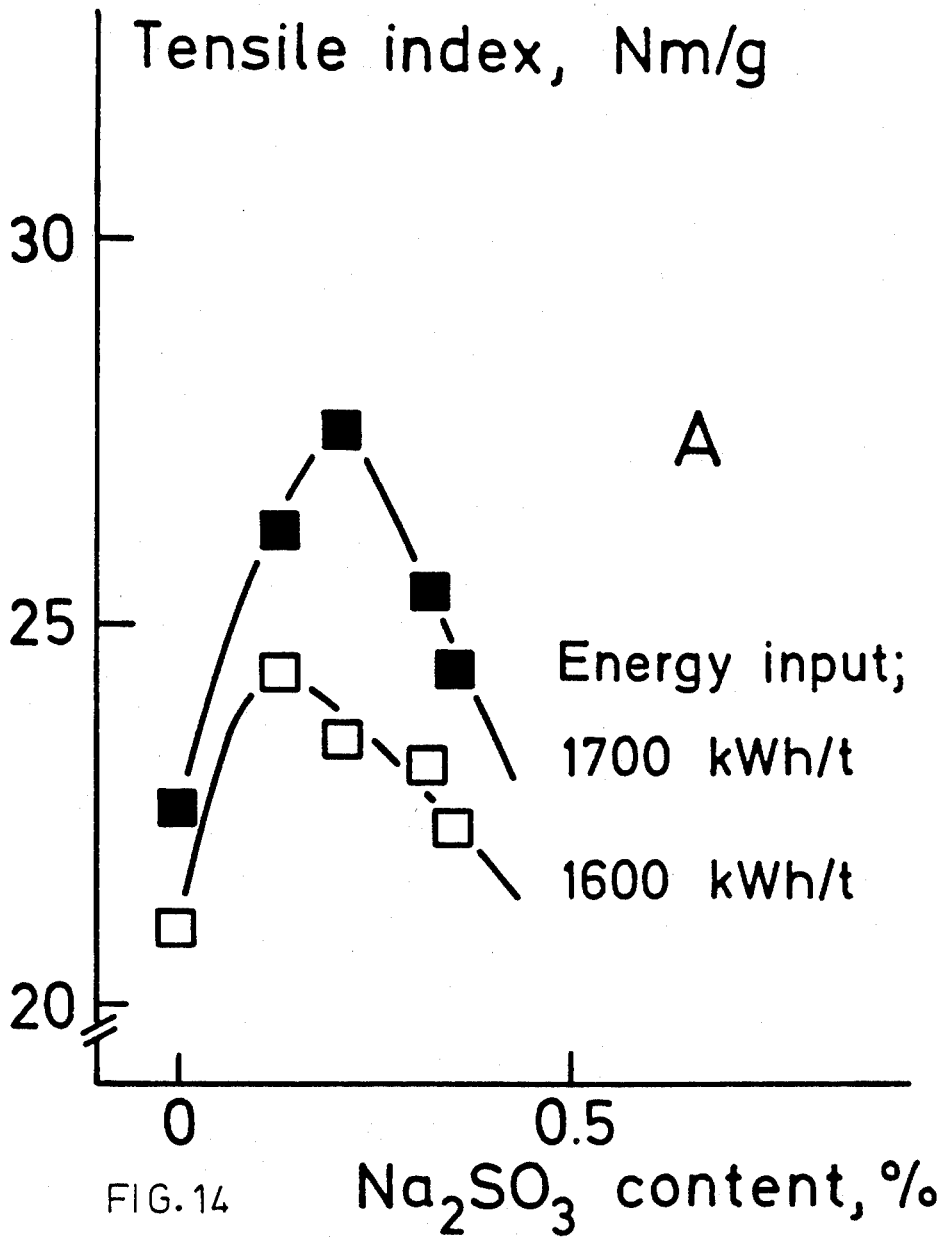

FIG. 14 and Table VI (fifth and sixth columns) show the tensile index (Nm/g) at different energy inputs as a function of the pulp sulfur content (expressed as wt. % $Na_2SO_3$ on o.d. wood). The maximum in tensile index obtained, referred to as optimum condition in the instant application, was located at a somewhat lower sulfite impregnating level than that referred to as optimum for the softwood mixture and the case of a non-pressurized, first-stage refiner used in Example 2. This general displacement towards lower sulfur contents (cf. also Example 4, below) is due to the use of a pressurized, first-stage refiner in the illustrative Examples 3 and 4. Optimum conditions with respect to tensile index and energy requirement (cf. FIG. 15 below) are dependent on a proper balance between the chemical softening of the wood, achieved by lignin sulfonation, and the thermal softening. With the use of a pressurized, first-stage refiner, the degree of thermal softening reached is higher than that in a non-pressurized system. This condition must be compensated for by lowering the degree of sulfonation. If this is not done, the critical state arises in which the lignin in the wood structure is softened by chemical and thermal means to such an extent that a fiber-fiber separation more or less located to the middle lamella region will take place, resulting in fibers, more extensively lignin-coated, with poor bonding potential.

Figure 15:
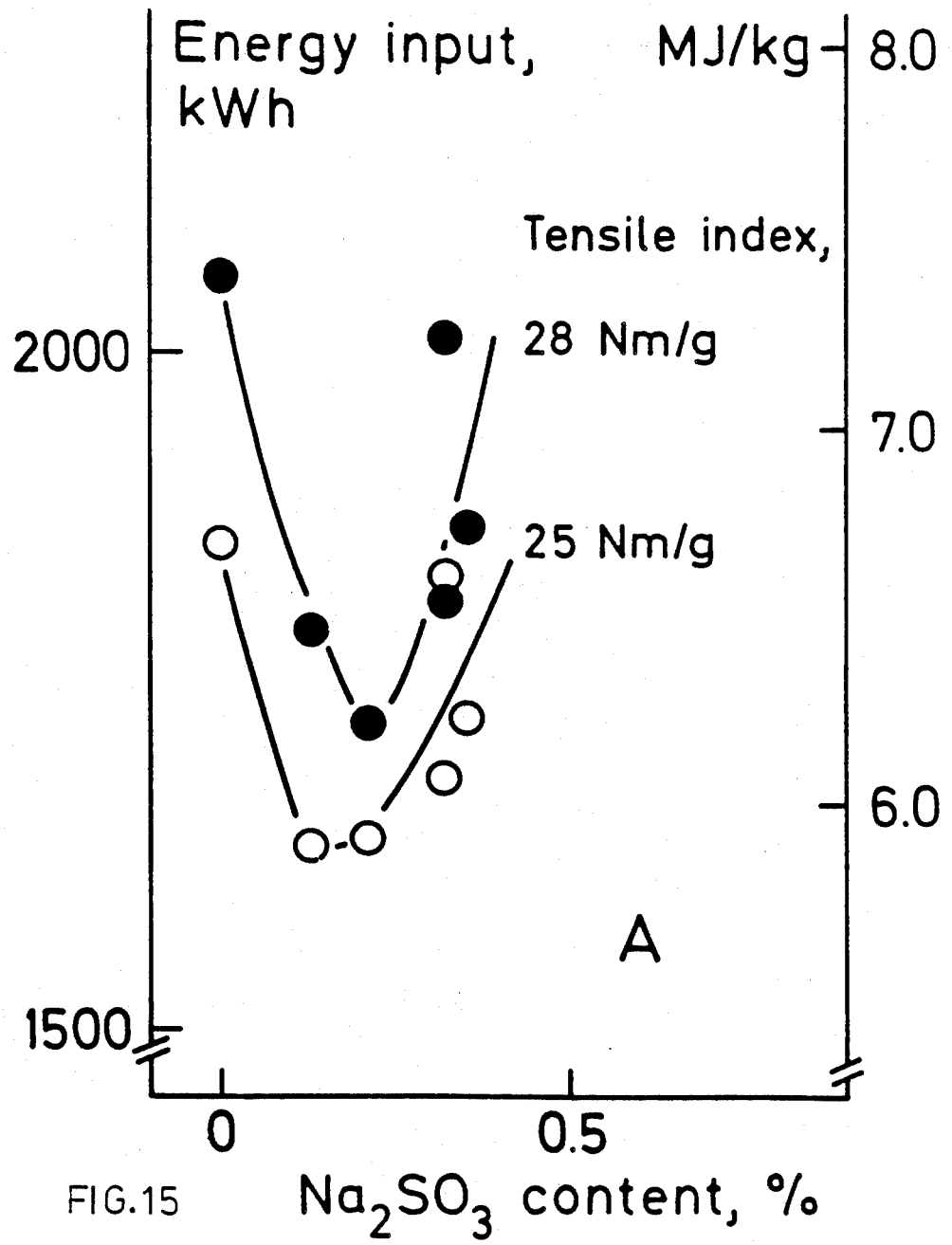

FIG. 15 shows the energy input (kWh/t) required to obtain a tensile index of 25 and 28 Nm/g, respectively, as a function of the pulp sulfur content (expressed as wt. % $Na_2SO_3$ on o.d. pulp). As can be seen, the curves are mirror representations of the curves in FIG. 14.

Figure 16:
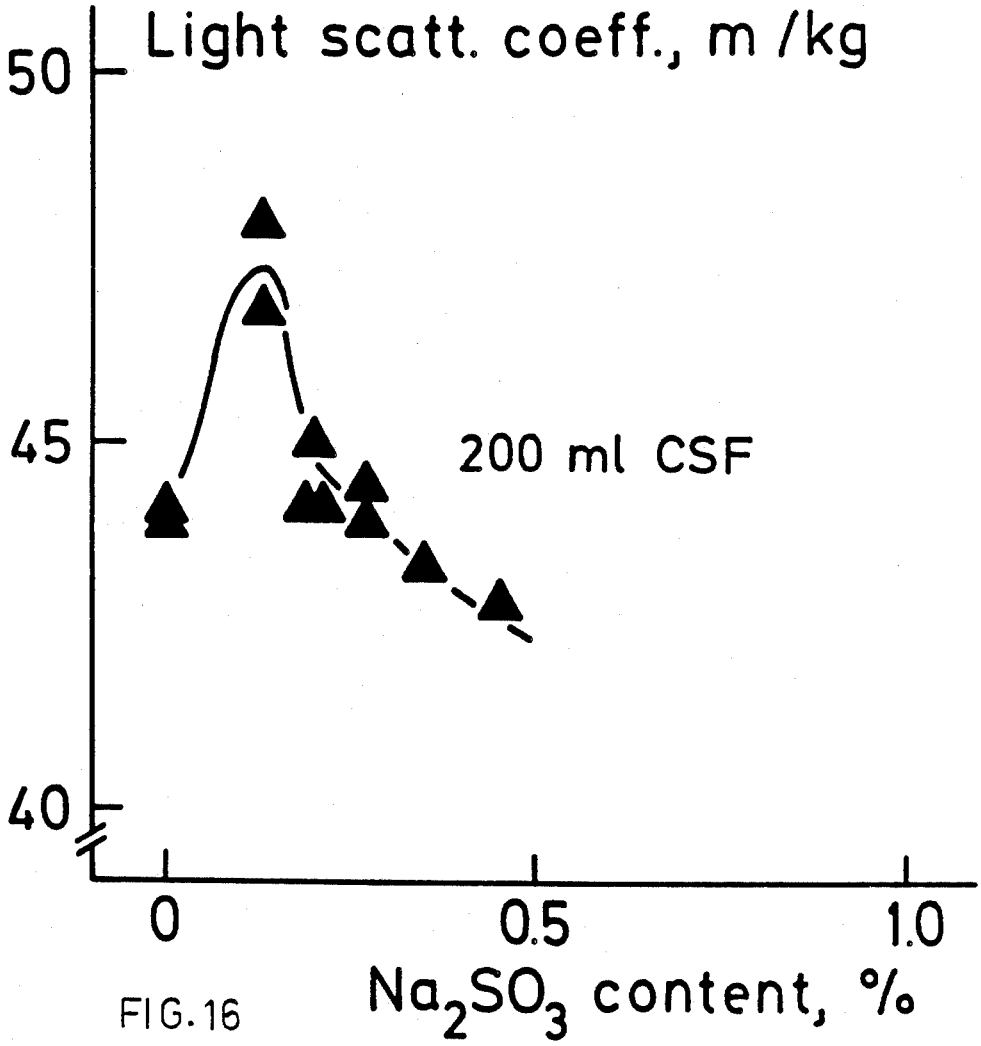

FIG. 16 and Table VI (seventh column) show the lightscattering coefficient ($m^2$/kg) at a drainability of 200 ml CSF as a function of the pulp sulfur content (expressed as wt. % $Na_2SO_3$ on o.d. pulp).

EXAMPLE 4

A mixture of industrial spruce and pine wood chips with the composition 75 wt. % spruce and 25 wt. % pine was pretreated, defibrated, and refined according to the procedure described in Example 3 (pressurized, first-stage refiner).

Figure 17:
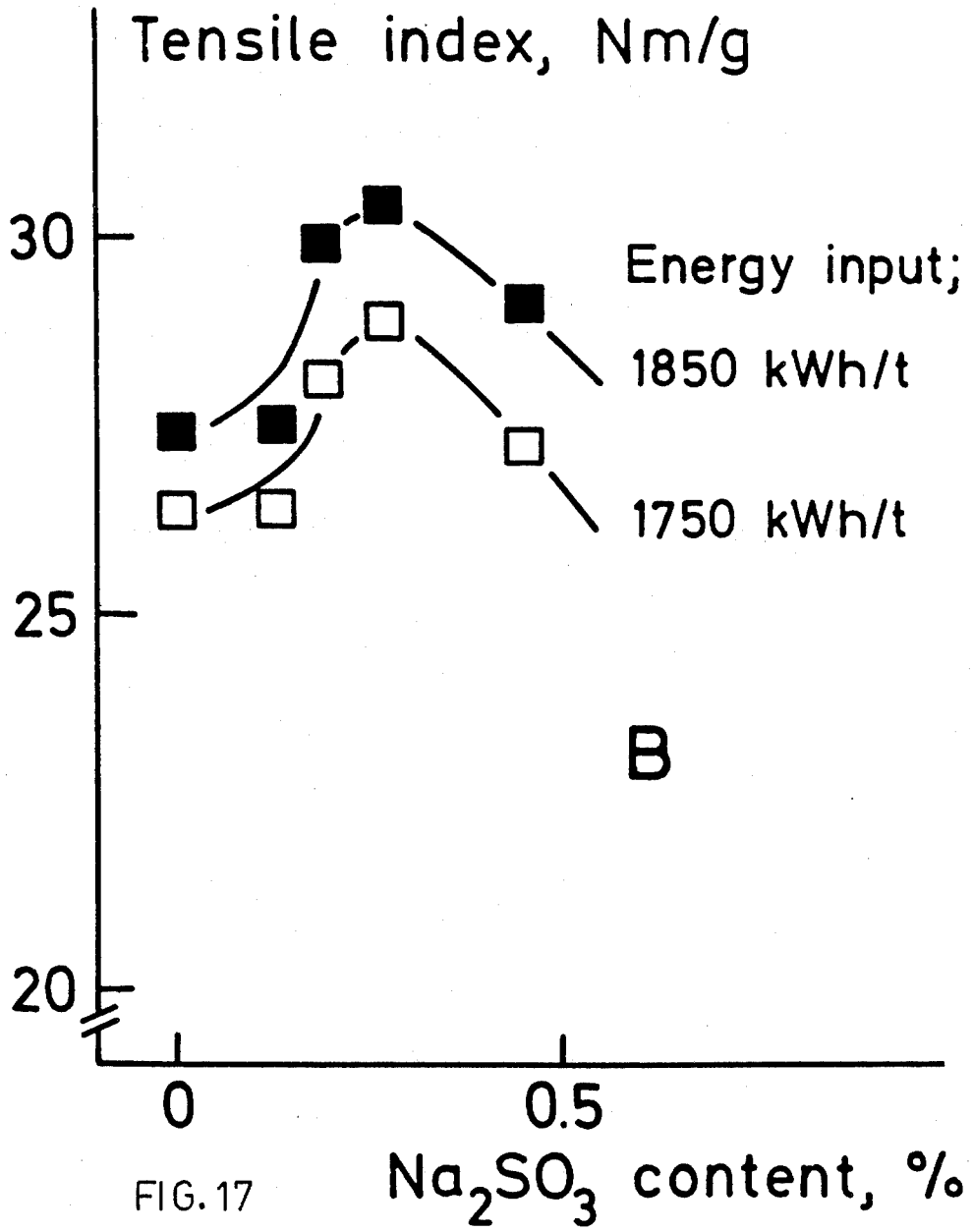
FIG. 17 shows the result obtained in a fourth illustrative Example.

The sulfur contents and the properties of the pulps produced appear from Table VII and FIG. 17.

TABLE VII

| Test No. | Content of $Na_2SO_3$, wt. %, in chips* | Pulp sulfur content, wt. %* | pH in pulp | Tensile index, Nm/g, at energy input of 1750 kWh/t | 1850 kWh/t | Light scattering coeff., $m^2$/kg |
|---|---|---|---|---|---|---|
| 32 | 0 | 0 | 4.9 | 26.3 | 27.4 | 39.9 |
| 33 | 0.12 | 0.12 | 5.1 | 26.4 | 27.5 | 46.8 |
| 34 | 0.33 | 0.19 | 5.3 | 28.1 | 29.9 | 45.0 |
| 35 | 0.56 | 0.27 | 5.4 | 28.9 | 30.4 | 43.9 |
| 36 | 0.80 | 0.45 | 5.7 | 27.1 | 29.1 | 42.8 |

*Calculated as percent by weight $Na_2SO_3$ on oven dry chips and pulp, respectively.

FIG. 17 shows the tensile index (Nm/g) of the pulps produced at different energy inputs as a function of the pulp sulfur content (expressed as wt. % $Na_2SO_3$ on o.d. pulp). The lower spruce content of the chip mixture compared to that used in Example 3 caused a displacement of the pulp sulfur content, referred to as optimum conditions, towards a somewhat higher value (compare also Examples 1 and 2). The results clearly demonstrate the influence of the spruce content.

EXAMPLE 5

The impregnation of softwood with sulfite as a pretreatment step prior to defibration and refining of chips was studied on a laboratory scale using sodium sulfite solutions containing trace amounts of radioactive sulfur. Spruce wood blocks of the dimension 60×20×10 mm (longitudinal×tangential×radial) were steamed with water vapor at atmospheric pressure (100° C.) and then immediately immersed in the impregnating solution. The treatments performed and the denotations used are given in Table VIII. After impregnation, each wood block was cut parallel to the fiber direction in 0.4 mm thick slices with a microtome. The amount of sulfite (calculated from the counts per min, cpm-values, recorded by means of a Geiger-Müller counter) that had penetrated into the wood in the longitudinal, tangential, or radial direction, was determined on the slices.

TABLE VIII

| Sample denotation | Atmospheric steaming, min | Impregnation 20° C., min | Heating 130° C. min |
|---|---|---|---|
| ▲ | 5 | 10 | — |

TABLE VIII-continued

| Sample denotation | Atmospheric steaming, min | Impregnation 20° C., min | Heating 130° C. min |
|---|---|---|---|
| Δ | 10 | 10 | 15 |
| ◀ | 15 | 10 | — |
| ■ | — | 60 min at 90° C. | — |

Figure 18:
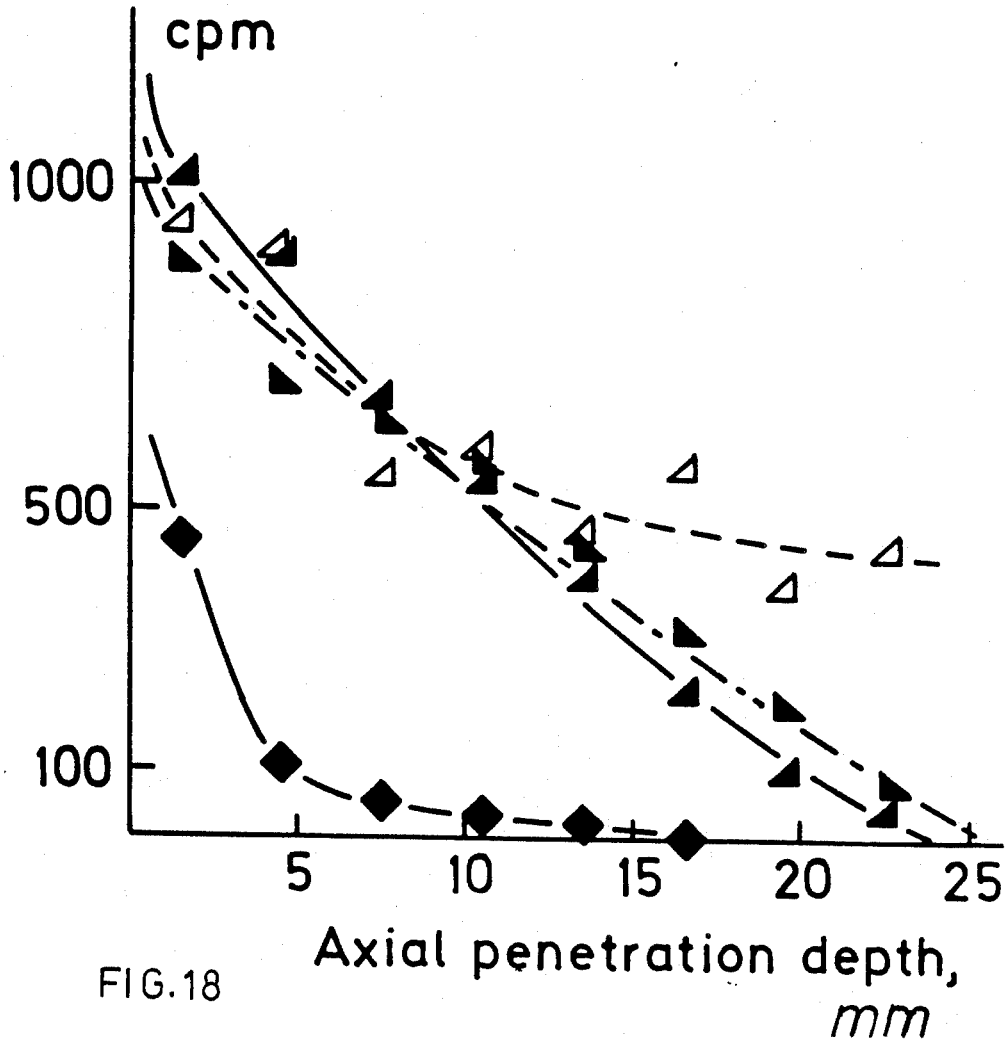
FIG. 18 shows the result obtained in a fifth illustrative Example.

FIG. 18 shows the cpm-values recorded, starting from the transverse end surface and along the middle of the slice originating from the centre of the wood block, as a function of the penetration depth (mm) in the longitudinal (axial) direction. As a comparison, the results obtained when carrying out the impregnation at 90° C. for 60 min without presteaming are included. As can be seen, the pretreatment adopted, comprising atmospheric steaming immediately followed by impregnation, resulted in a very thorough impregnation. Furthermore, a heat treatment of the drained, impregnated chips, corresponding to the preheating step used industrially as a conventional stage of the thermomechanical pulping process (TMP), improved the impregnation by equalizing the sulfite concentration gradient inside the wood.

CONCLUSIONS AND DISCUSSION

The results presented in the illustrative Examples 1–4 show that a proper chemical softening and weakening of the wood structure by lignin sulfonation (especially, as discussed below, at certain specific parts of the wood cell of utmost importance to the fiber-fiber separation) yields great beneficial and additional effects as compared to thermal softening alone, as illustrated for the pulps to which no sulfite was added. However, chemical softening by the addition of sulfite prior to defibration is a very intricate matter, if optimum strength properties are to be achieved with a minimum of energy input and while retaining the good optical properties of a mechanical pulp. Unexpectedly, the best results with respect to pulp quality and energy input were found at sulfite additions amounting to only a few tenth of one per cent (calculated as wt. % $Na_2SO_3$ on o.d. wood). Besides, a high pulp yield (>95%) and a high utilization of the chemicals added were obtained. Dilute impregnating solutions could also be used.

When the wood chips enter the first-stage refiner, a disintegration of the wood pieces takes place in the breaker-bar section, followed by a fiber-fiber separation (defibration). Literature teaches that of all the parts of the wood tracheid cell wall, the pit-free or less-pitted tangential walls are the least resistant to surface loosening, while the ray contact areas are the most resistant, with the pitted radial walls falling somewhere in between. To facilitate the fiber-fiber separation, a chemical softening with the occurrence of a specific sulfite attack within these areas of high resistance to surface loosening is important. In addition to the thermal softening, a proper sulfonation causes a further weakening of the structure in the pitted wall and the ray contact areas, i.e. parts of the wood structure which are also easily reached by the chemicals due to liquid penetration. Accordingly, a larger long-fiber fraction consisting of undamaged, fibrillated fibers with a comparatively low amount of middle lamella fragments on their surfaces will be formed. At too high a degree of chemical softening, on the other hand, the lignin softening will result in the formation of fibers, probably coated with middle lamella lignin to an increased extent, with a poor strength potential. Such fibers are not easily refined and will require an increased energy input in order to reach a certain pulp property level.

When the sulfur content of the pulp is further increased beyond the limits investigated in the present study, as taught by Ford et al. (U.S. Pat. No. 4,116,758, Sept. 26, 1978), the heavy chemical treatment will result in a dissolution of wood components, giving a considerably lower yield. Furthermore, to achieve such a degree of lignin sulfonation as stated by Ford et al., a pressurized device for chip treatment is needed, including the use of concentrated sulfite solutions, high temperature during prolonged treatment time ("cooking"), and a system for recovery of chemicals and waste liquor treatment. Thus, a properly performed sulfonation, in good balance with thermal softening, is an efficient tool for improving thermomechanical pulping. From the discussion, and the results presented, it also follows that the use of a pressurized, first-stage refiner with a higher degree of thermal softening must be compensated for by a lower degree of chemical softening, i.e. to retain optimum conditions a lower sulfite impregnating level is needed (cf. FIG. 1). If a two-stage operation is performed, it is not essential whether the second refining stage is carried out in an open refiner or not, although a non-pressurized refiner is mostly used in this stage. Thus, it must be borne in mind that only the conditions in the first-stage refiner (pressurized or nonpressurized) are essential with respect to the critical balance between chemical and thermal softening.

As can be seen from the illustrative Examples, the partial substitution of pine for spruce in the raw material called for an increase of the sulfite impregnating level to obtain the conditions referred to as optimum conditions in the instant application. Without being bound to any particular theory, it is presently believed that this finding is due to differences in morphological structure and resin content between pine and spruce wood. According to the rather scarce results presented in the literature, the ray-tracheid contact area in pine is much larger than that in spruce. As discussed above, the cross fields between rays and fibers are very resistant to surface loosening and, therefore, it seems likely that a higher sulfite impregnating level is required in the case of pine in order to achieve a proper lignin softening due to sulfonation in these areas. The relationship between fiber wall thickness, fiber width and fiber length for different softwood species may also play a significant part, although theories and general data are presently lacking to a great extent. Furthermore, the introduction of a hydrophilic reactant like sulfite is most likely affected by the resin content, determined as ether-soluble extractives, which is lower in species of spruce and fir than in pine.

In the claims, the content of spruce or softwood species equivalent to spruce is limited to the range 100–70% spruce in the raw material. As evident from the illustrative Examples, the invention is fully applicable within the range, and no sign of a sudden change at a spruce content of 70% has been found. However, a further decrease of the spruce content, i.e. a further increase of the content of resinous pine wood, would increase the need for a more severe chemical pretreatment to obtain a more complete deresination sometimes required for certain pulp applications. Such severe chemical pretreatments which adversely affect the critical balance between chemical and thermal softening and the pulp yield are considered outside the scope of the instant invention.

Where the term spruce is used herein, it is understood to include spruce and spruce-like materials, i.e. equivalent softwood lignocellulosic materials exhibiting spruce-like characteristics for the purposes of this invention, i.e. comparatively long fibers (which excludes hardwoods like birch, maple etc), comparatively small ray-tracheid contact area, and comparatively low resin content. On refining a wood mixture, the minor part of the mixture may consist of pine or aspen wood.

The use of a sulfite treatment at a low sulfite impregnating level is not restricted to the case where the starting fiber material consists of green or seasoned wood, but it is also applicable to defibration/refining of rejects obtained in the production of mechanical pulps.

The instant invention relates to the positive effects achieved at low, optimum sulfonation of the wood prior to mechanical treatment. It is well known that lignin sulfonation can be carried out with any of the species which are part of the sulfite system:

$$SO_2+H_2O \rightleftharpoons H_2SO_3$$

$$H_2SO_3+H_2O \rightleftharpoons HSO_3^-+H_3O^+$$

$$HSO_3^-+H_2O \rightleftharpoons SO_3^{2-}+H_3O^+$$

Figure 19:
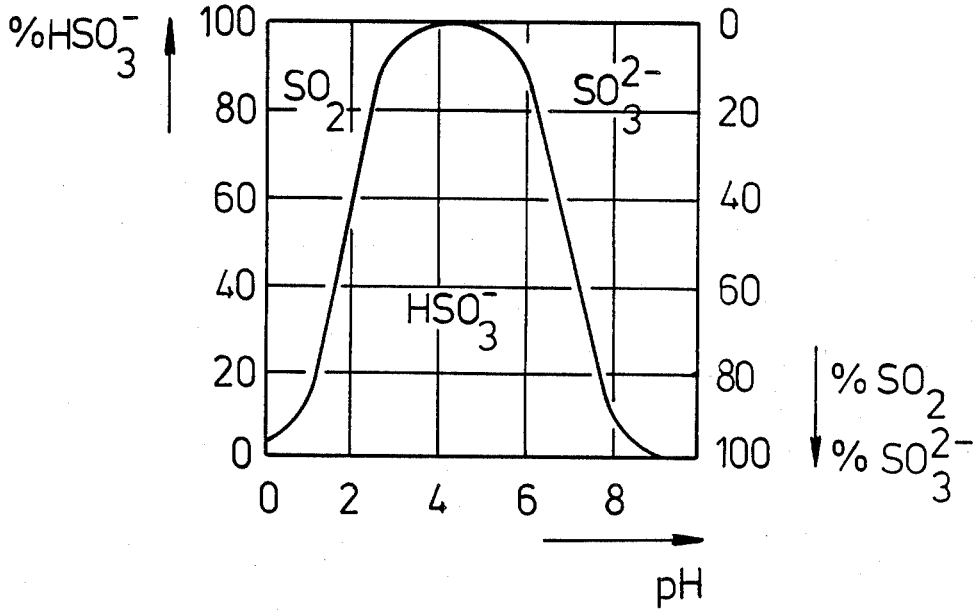
FIG. 19 shows the occurrence of the different species of sulfite as a function of pH.

The presence of the different species in an aqueous system is determined by the pH-value in the system, the relationship being shown in FIG. 19. Due to the presence of acidic groups in the wood, the saponification of ester bonds, and the formation of sulfonic acid groups, the pH-value in the impregnated wood is not only determined by the pH-value of the impregnating solution but also is influenced by the wood. To obtain a proper, optimum sulfonation according to the invention, any sulfite containing chemical with a sufficient water solubility selected from the group sulfurous acid, metal bisulfite salts, and metal sulfite salts can be used as impregnating chemical The metal ion component may be calcium, magnesium, potassium and sodium, or a cation like ammonium ion, with sodium sulfite ($Na_2SO_3$) being preferred. The range within which the material is preheated in the conventional thermomechanical pulping stage can be chosen to be wider than that mentioned above in the illustrative Examples. A suitable range is about 110°-130° C., but preferably is 115°-126° C.

The invention is not restricted to the illustrative Examples shown in the drawings and the Tables and described above but can also be varied within the scope of the appended claims.

SUMMARY

A low, optimum impregnating level of sulfite according to the invention (FIG. 1) results in the following advantages, compared with the additions normally used today and the procedures known:

1. High pulp yield

The mild chemical treatment results in a high pulp yield (>95%)

2. High degree of utilization of the impregnating sulfite (see FIGS. 3, 10, 15)

After refining, about 98% of the sulfite added are found in the pulp in a chemically bonded form, which means that no amount, or an extremely low amount, of unreacted sulfite is present in the pulp. This is favorable with respect to the consumption of hydrogen peroxide in a subsequent bleaching step, and eliminates the need for an intermediate washing step as well as the need for a separate sulfite recovery system.

3. Low chemical cost

The cost of chemicals is low, particularly in the refining step, but also during hydrogen peroxide bleaching as a result of an extremely low or absent concentration of unreacted sulfite in the pulp.

4. Low costs of installation of pretreatment equipment

Steaming with water vapor at atmospheric pressure as well as a non-pressurized impregnation with sulfite solution means that a simple equipment can be used. The investment costs can therefore be kept low both when installing new equipment and when supplementing or modifying an existing plant.

5. Low shives content

Even a low sulfite impregnating level results in a noticeable decrease in the shives content (see FIGS. 4, 11).

6. Low energy input

On beating to a constant drainability (see FIG. 8) or, alternatively, a constant tensile index (see FIGS. 7, 15), a considerably lower energy input is required at a low, optimized sulfite batching than otherwise. Thus, energy savings of the magnitude of 20% can be obtained.

7. Good strength properties

At constant energy input, a maximum tensile index is obtained at low, optimized sulfite batching (see FIGS. 6, 12, 14, and 17). A corresponding tensile index value is not obtained until the sulfite addition is considerably increased (see FIGS. 3 and 6), but then the pulp yield is adversely affected.

8. Maximum light-scattering coefficient

At low, optimized sulfite batching, a maximum in light-scattering coefficient is obtained (see FIGS. 9 and 16) With increased sulfite impregnating level, a rapid deterioration of the light-scattering property occurs. When mechanical pulp is used in different grades of printing paper, a high light-scattering coefficient is an essential quality requirement.

What is claimed is:

1. A method for the production of fiber pulps of high strength from a lignocellulosic starting material, comprising the steps of lignin softening and mechanical defibration, said lignocellulosic starting material being selected from the group consisting of spruce, spruce-like wood materials and mixtures of lignocellulosic materials, said mixtures containing at least 70% spruce or spruce-like wood materials, and said step of lignin softening comprising impregnating, before said defibration, said starting material with a dilute aqueous solution of a sulfite containing lignin softening agent, in a sufficient amount to provide in the fiber pulp after said step of mechanical defibration an absorbed and bonded amount of sulfonate groups within the range of from 0.06 to 0.75 wt. %, calculated as $Na_2SO_3$ and based on the dry pulp weight, said absorbed and bonded amount being balanced to the composition of the starting material and the temperature-pressure conditions in the defibration step to provide a pulp of maximum tensile strength.

2. The method according to claim 1, wherein the absorbed and bonded amount of sulfonate groups after defibration balanced to meet the sprucewood content of said starting material as defined by the area between lines AB and GH in FIG. 1, the coordinates for the points A, B, G and H being

| | spruce content | S as $Na_2SO_3$ |
|---|---|---|
| A | 100 wt. % | 0.3 wt. % |
| B | 70 wt. % | 0.75 wt. % |
| G | 70 wt. % | 0.14 wt. % |
| H | 100 wt. % | 0.06 wt. % |

3. The method according to claim 1, wherein the absorbed and bonded amount of sulfonate groups after atmospheric defibration is balanced to meet the sprucewood content of the starting material defined by the area between lines AB and CD in FIG. 1, the coordinates for the points A, B, C and D being

| | spruce content | S as $Na_2SO_3$ |
|---|---|---|
| A | 100 wt. % | 0.3 wt. % |
| B | 70 wt. % | 0.75 wt. % |
| C | 70 wt. % | 0.25 wt. % |
| D | 100 wt. % | 0.1 wt. % |

4. The method according to claim 3, wherein the absorbed and bonded amount of sulfonate groups is balanced to meet the sprucewood content of the starting material defined substantially by the line IK in FIG. 1, the coordinates for the points I and K being

| | spruce content | S as $Na_2SO_3$ |
|---|---|---|
| I | 100 wt. % | 0.2 wt. % |
| K | 70 wt. % | 0.5 wt. % |

5. The method according to claim 1, wherein the absorbed and bonded amount of sulfonate groups after defibration under pressure of 140 kPa is balanced to meet the sprucewood content of the starting material defined by the area between lines EF and GH in FIG. 1, the coordinates for the points E, F, G and H being

| | spruce content | S as $Na_2SO_3$ |
|---|---|---|
| E | 100 wt. % | 0.18 wt. % |
| F | 70 wt. % | 0.42 wt. % |
| G | 70 wt. % | 0.14 wt. % |
| H | 100 wt. % | 0.06 wt. % |

6. The method according to claim 5, wherein the absorbed and bonded amount of sulfonate groups is balanced to meet the sprucewood content of the starting material defined substantially by the line LM in FIG. 1, the coordinates for the points L and M being

| | spruce content | S as $Na_2SO_3$ |
|---|---|---|
| L | 100 wt. % | 0.12 wt. % |
| M | 70 wt. % | 0.28 wt. % |

7. The method of claim 1, wherein, prior to impregnation with said dilute aqueous solution, said starting material is subjected to steaming to raise the temperature of said starting material to the temperature of the water vapor used for steaming.

8. The method of claim 7, wherein said steaming is performed at about atmospheric pressure and for at least about 10 minutes.

9. The method of claim 1, wherein said impregnation is performed at atmospheric pressure during a period of time of about 10 minutes.

10. The method of claim 1, wherein, subsequent to said impregnation step but prior to defibration, the impregnated material is preheated.

11. The method of claim 10, wherein said impregnated material is preheated at about 110°-130° C. for about 3 minutes.

12. The method according to claim 1, wherein the impregnated material is defibrated by introducing the impregnated material into a disc-refiner operating at a refining pressure in the range of from atmospheric to 140 kPa.

* * * * *